United States Patent [19]

Yamamoto et al.

[11] Patent Number: 5,021,705

[45] Date of Patent: Jun. 4, 1991

[54] METHOD OF FABRICATING AN IMAGE PICK-UP TUBE AND TARGET SECTION USED THEREWITH

[75] Inventors: Masanao Yamamoto; Takaaki Unnai; Shigeru Ehata, all of Mobara; Tadaaki Hirai, Koganei; Kenji Sameshima, Hachioji; Eikiyu Hiruma, Komae; Shirou Suzuki, Yokosuka; Kenkichi Tanioka, Tokyo; Junichi Yamazaki, Kawasaki; Keiichi Shidara, Tama, all of Japan

[73] Assignees: Hitachi Ltd.; Nippon Hoso Kyokai, both of Tokyo, Japan

[21] Appl. No.: 357,513

[22] Filed: May 24, 1989

[30] Foreign Application Priority Data

May 27, 1988 [JP] Japan ..... 63-128343

[51] Int. Cl.[5] ..... H01J 31/08; B05D 5/06; B05D 5/12

[52] U.S. Cl. ..... 313/106; 313/384; 313/386; 313/390; 427/74; 427/77

[58] Field of Search ..... 313/384, 385, 386, 387, 313/390, 106, 107; 427/74, 77

[56] References Cited

U.S. PATENT DOCUMENTS 4,366,413 12/1982 Washida et al. ..... 313/107 X

FOREIGN PATENT DOCUMENTS 40809 10/1977 Japan .
131349 6/1986 Japan .
72037 4/1988 Japan .

OTHER PUBLICATIONS

"Image Pickup Engineering", Published from Corona, 12/75, pp. 109–116.
IEEE Electron Device Letters, EDL-8, No. 9 (12/87) pp. 392–394.
"A Collection of Drafts for Speeches Before National Conference of Television Society", 12/82, Kawamura et al., pp. 81–82.

*Primary Examiner*—Donald J. Yusko
*Assistant Examiner*—John Giust
*Attorney, Agent, or Firm*—Antonelli, Terry, Stout & Kraus

[57] ABSTRACT

An image pick-up tube and a method of fabricating an image pick-up tube and a target section used therewith, in which the target includes at least a conductive film and a photoconductive film on a substrate for photoelectric conversion, and a signal from the target section is read by an electron beam scanning system. At least a part of the surface area outside the effective scanning region of the electron beam scanning side of the target section is formed of a secondary electron emission dampening layer.

23 Claims, 15 Drawing Sheets

SCHEMATIC DIAGRAM OF M-M TYPE IMAGE PICK-UP TUBE

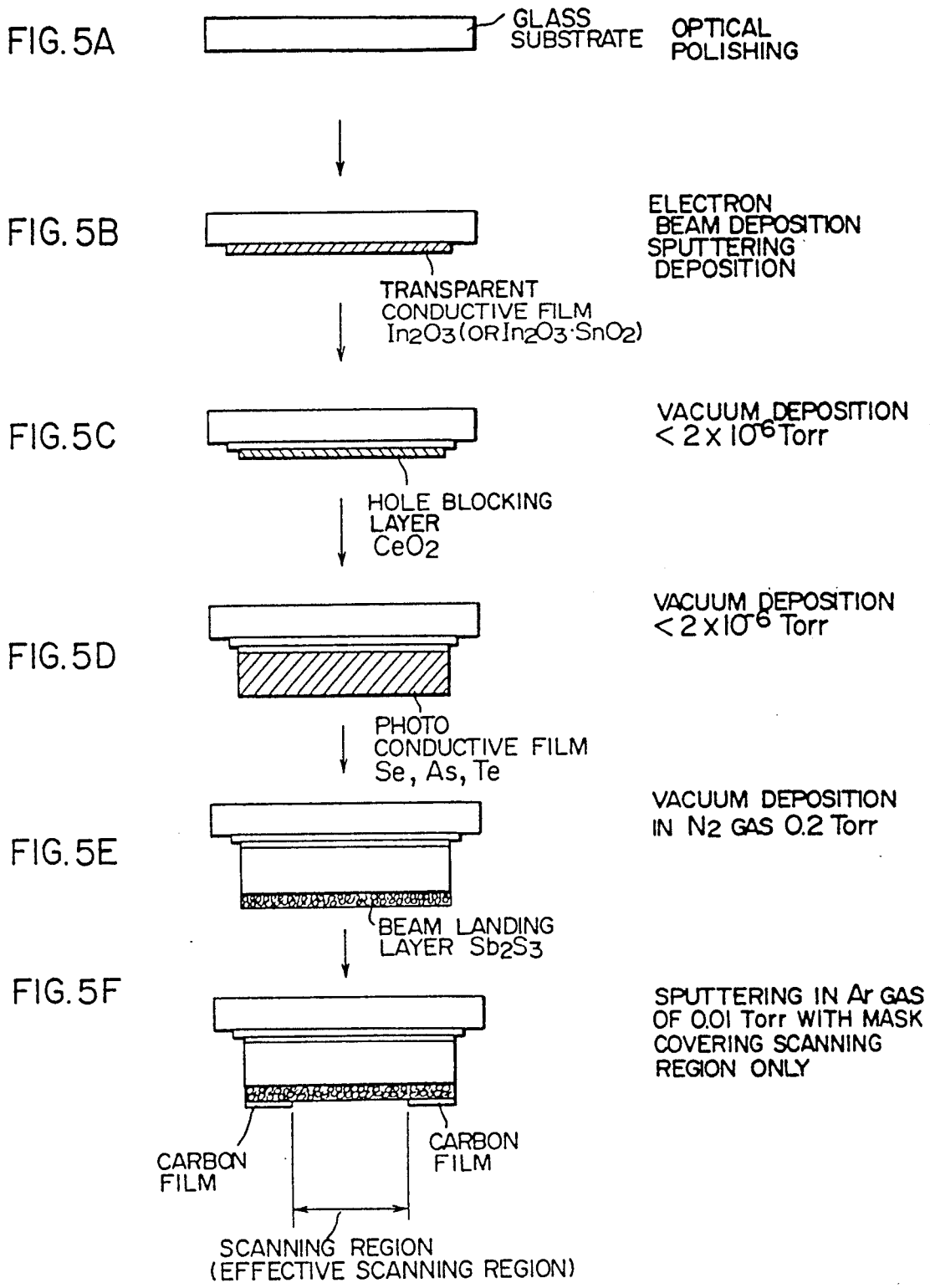
FIG. 5A
GLASS SUBSTRATE
OPTICAL POLISHING
FIG. 5B
ELECTRON BEAM DEPOSITION
SPUTTERING DEPOSITION
TRANSPARENT CONDUCTIVE FILM
In2O3 (OR In2O3·SnO2)
FIG. 5C
VACUUM DEPOSITION
< 2 x 10-6 Torr
HOLE BLOCKING LAYER
CeO2
FIG. 5D
VACUUM DEPOSITION
< 2 x 10-6 Torr
PHOTO CONDUCTIVE FILM
Se, As, Te
FIG. 5E
VACUUM DEPOSITION
IN N2 GAS 0.2 Torr
BEAM LANDING LAYER Sb2S3
FIG. 5F
SPUTTERING IN Ar GAS OF 0.01 Torr WITH MASK COVERING SCANNING REGION ONLY
CARBON FILM
CARBON FILM
SCANNING REGION
(EFFECTIVE SCANNING REGION)

OPTICAL POLISHING

ELECTRON BEAM DEPOSITION
SPUTTERING DEPOSITION

VACUUM DEPOSITION
$< 2 \times 10^{-6}$ Torr

VACUUM DEPOSITION
$< 2 \times 10^{-6}$ Torr

VACUUM DEPOSITION IN $N_2$ GAS 0.2 Torr USING MESH MASK (TRANSMITTANCE OF A MESH MASK CORRESPONDING TO THE OUTSIDE OF EFFECTIVE SCANNING REGION IS FOUR TIMES HIGHER THAN THAT CORRESPONDING TO THE EFFECTIVE SCANNING REGION)

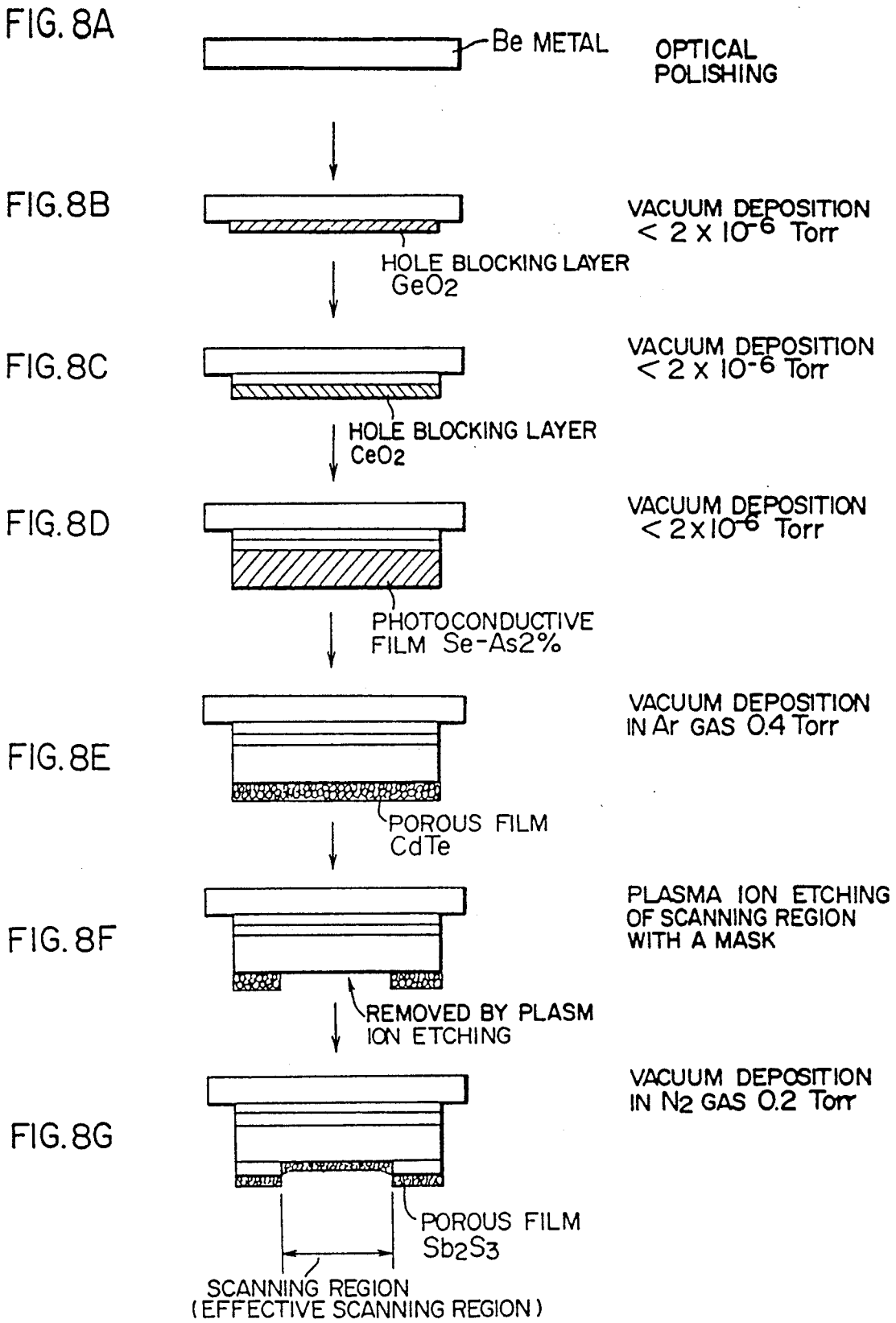
FIG. 8A
Be METAL
OPTICAL POLISHING
FIG. 8B
VACUUM DEPOSITION < 2 x 10-6 Torr
HOLE BLOCKING LAYER GeO2
FIG. 8C
VACUUM DEPOSITION < 2 x 10-6 Torr
HOLE BLOCKING LAYER CeO2
FIG. 8D
VACUUM DEPOSITION < 2x10-6 Torr
PHOTOCONDUCTIVE FILM Se-As2%
FIG. 8E
VACUUM DEPOSITION IN Ar GAS 0.4 Torr
POROUS FILM CdTe
FIG. 8F
PLASMA ION ETCHING OF SCANNING REGION WITH A MASK
REMOVED BY PLASM ION ETCHING
FIG. 8G
VACUUM DEPOSITION IN N2 GAS 0.2 Torr
POROUS FILM Sb2S3
SCANNING REGION (EFFECTIVE SCANNING REGION)

OPTICAL POLISHING

SPUTTERING (USE MASK WITH HATCHED PORTION OPEN)

BY USING ULTRASONIC BORER

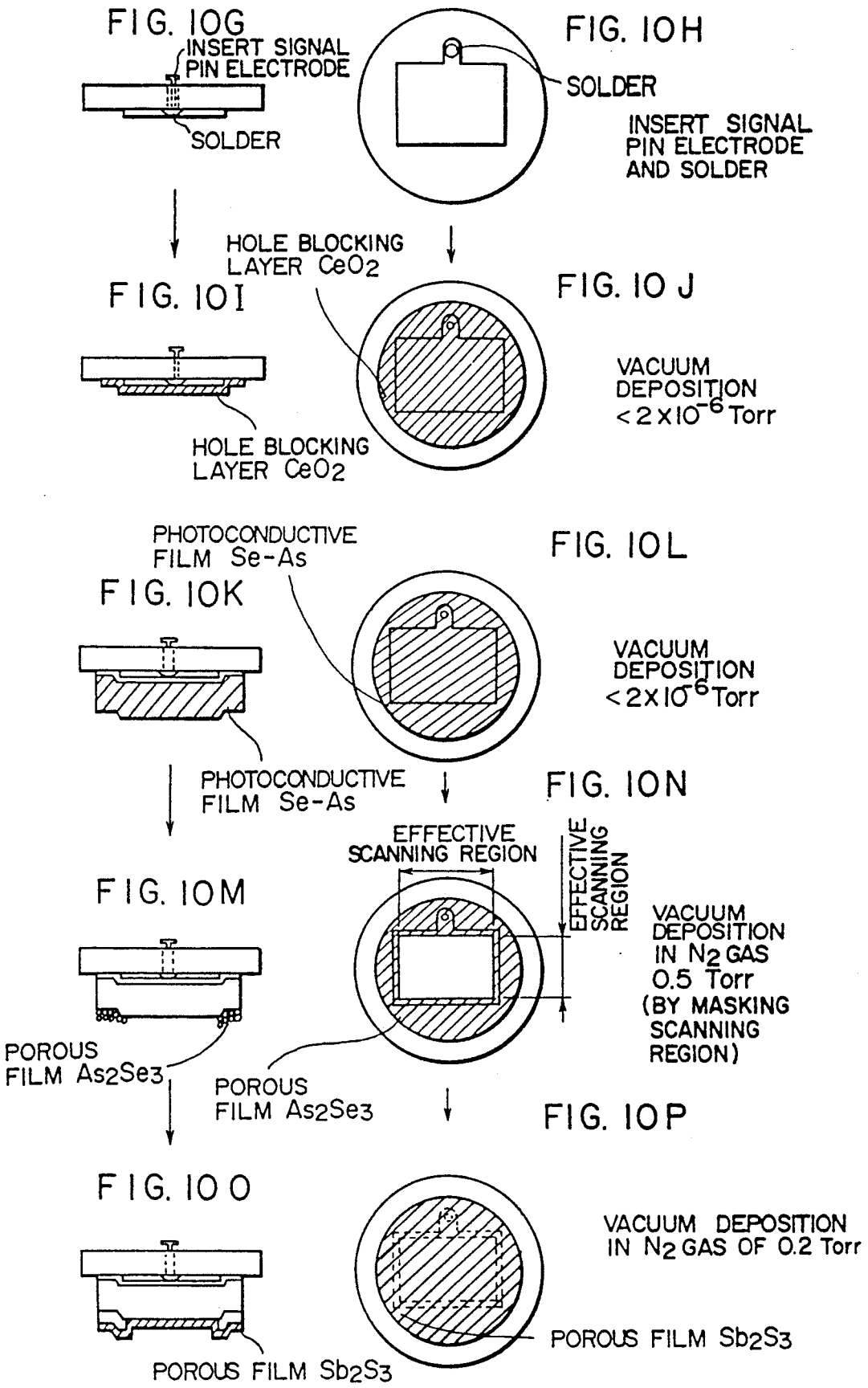
FIG. 10G
INSERT SIGNAL PIN ELECTRODE
SOLDER
FIG. 10H
SOLDER
INSERT SIGNAL PIN ELECTRODE AND SOLDER
HOLE BLOCKING LAYER CeO2
FIG. 10I
HOLE BLOCKING LAYER CeO2
FIG. 10 J
VACUUM DEPOSITION <2×10^-6 Torr
PHOTOCONDUCTIVE FILM Se-As
FIG. 10K
PHOTOCONDUCTIVE FILM Se-As
FIG. 10L
VACUUM DEPOSITION <2×10^-6 Torr
FIG. 10N
EFFECTIVE SCANNING REGION
EFFECTIVE SCANNING REGION
FIG. 10M
POROUS FILM As2Se3
POROUS FILM As2Se3
VACUUM DEPOSITION IN N2 GAS 0.5 Torr (BY MASKING SCANNING REGION)
FIG. 10P
FIG. 10 O
VACUUM DEPOSITION IN N2 GAS OF 0.2 Torr
POROUS FILM Sb2S3
POROUS FILM Sb2S3

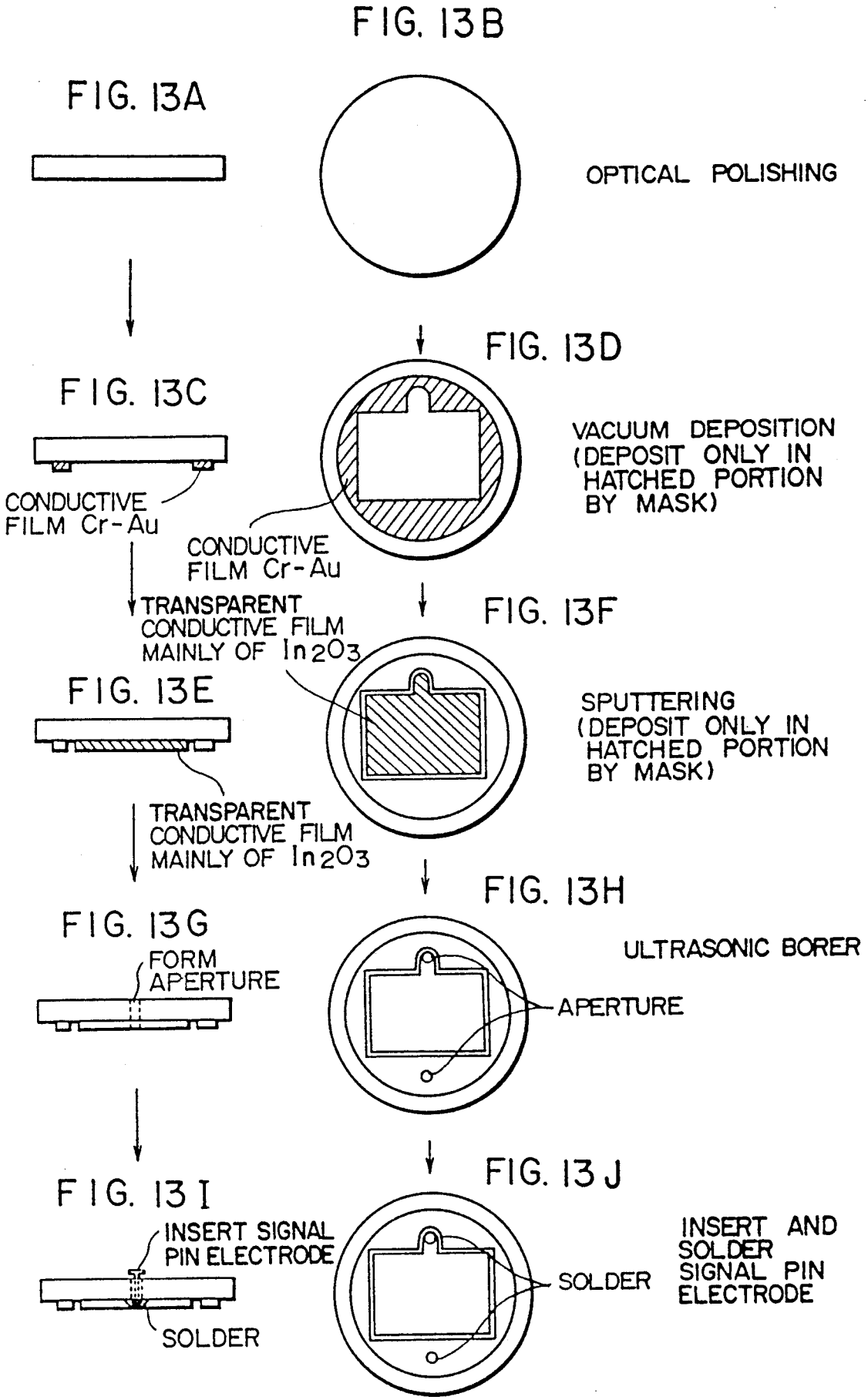
FIG. 13B
FIG. 13A
OPTICAL POLISHING
FIG. 13D
FIG. 13C
VACUUM DEPOSITION (DEPOSIT ONLY IN HATCHED PORTION BY MASK)
CONDUCTIVE FILM Cr-Au
CONDUCTIVE FILM Cr-Au
TRANSPARENT CONDUCTIVE FILM MAINLY OF In2O3
FIG. 13F
FIG. 13E
SPUTTERING (DEPOSIT ONLY IN HATCHED PORTION BY MASK)
TRANSPARENT CONDUCTIVE FILM MAINLY OF In2O3
FIG. 13H
FIG. 13G
ULTRASONIC BORER
FORM APERTURE
APERTURE
FIG. 13J
FIG. 13I
INSERT SIGNAL PIN ELECTRODE
INSERT AND SOLDER SIGNAL PIN ELECTRODE
SOLDER
SOLDER HOLE BLOCKING LAYER CeO2
φ20mm VACUUM DEPOSITION <2 x 10^-6 Torr
HOLE BLOCKING LAYER CeO2
PHOTOCONDUCTIVE FILM Se-As-Te VACUUM DEPOSITION <2 x 10^-6 Torr
PHOTOCONDUCTIVE FILM Se-As-Te VACUUM DEPOSITION IN N2 GAS 0.2 Torr
POROUS FILM Sb2S3
POROUS FILM Sb2S3

VACUUM DEPOSITION IN N GAS 0.2 Torr (DEPOSIT ONLY IN HATCHED PORTION)
POROUS FILM Sb2S3
POROUS FILM Sb2S3

1
2
5
4
5'

METHOD OF FABRICATING AN IMAGE PICK-UP TUBE AND TARGET SECTION USED THEREWITH

BACKGROUND OF THE INVENTION

The present invention relates to a photo-conductive-type image pick-up tube and an X-ray image pick-up tube, or more in particular to a method of fabricating an image pick-up tube having a target section suitable as an image pick-up tube with an increased target voltage and the particular target section used therewith.

Generally, a photoconductive-type image pick-up tube or an X-ray image pick-up tube (hereinafter referred to as an "image pick-up tube" collectively) comprises a target section for converting an entrant optical image or an X-ray image into a charge pattern and storing it and a scanning electron beam generation section for reading a stored charge pattern as a signal current, wherein the scanning-side surface potential is balanced with the cathode potential immediately after the target is subjected to the scanning of the electron beam.

An image pick-up tube is usually used with a voltage of 300 to 2,000 V applied to a mesh electrode with respect to a cathode and a target voltage of several volts to several hundred volts to a transparent conductive film. In operation, the surface potential at the scanning side of a scanning region may become higher than the cathode potential by a voltage determined by a signal current and the storage capacity of the target section. With a scanning electron beam attached to the surface, however, the potential thereof begins to drop until it is balanced with the cathode potential immediately after scanning. In the process, a part of the scanning electron beam attaches to the scanning-side surface of the target and causes a signal current, while the remaining part of the electron beam returns to the electron gun side and becomes what is called a return electron beam. A part of this return electron beam is reflected from the electrode wall and is scattered to enter the scanning region of the target or around thereof again.

Outside the scanning region, on the other hand, scanning electron beams do not attach unlike in the scanning region, and therefore the scanning-side surface potential is generally considered to be balanced with the target potential. In normal operation, the secondary electron emission ratio outside the scanning region is maintained at a value less than unity, and therefore upon entrance of scattered electrons or other in-tube stray electrons into an area outside the scanning region, the surface potential thereof tends to change, though slightly, toward the cathode potential. If there occurs a dark current or an photo-current due to the unrequired entrance of light, by contrast, these currents act to increase the surface potential, so that the surface potential outside the effective scanning region tends to increase and be balanced with the target potential again. While the image pick-up tube is in operation, therefore, the scanning-side surface potential outside the scanning region is considered to have two factors of change balanced with each other. Specifically, the two factors for changing the scanning-side surface potential outside the scanning region include the current flowing in a photoconductive film acting to increase the scanning-side surface potential and the scattered electrons attached to the scanning-side surface acting to decrease the scanning-side surface potential. The current in the photoconductive film is adapted to flow therein only when there is a potential difference thereacross, and therefore even if the scanning-side surface potential outside the scanning region is increased by the current flowing in the photoconductive film, it would not increase beyond the target potential. As long as the image pick-up tube is in this way of operation, the scanning-side surface potential outside the scanning region is kept below the target potential, and unless the secondary electron emission ratio at this part exceeds unity, the operation of the image pick-up tube remains stable. The conventional image pick-up tubes are operated in such a condition.

These conventional image pick-up tubes are discussed, for example, in "Image Pick-Up Engineering" by Ninomiya et al., published from Corona in 1975, pp. 109 to 116, IEEE Electron Device Letters, EDL-8, No. 9 (1987) pp. 392 to 394, and "A Collection of Drafts for Speeches Before National Conference of Television Society (1982)", by Kawamura et al., pp. 81 to 82. In these conventional image pick-up tubes, if the scanning-side surface is liable to emit secondary electrons by the scanning electron beam, the above-mentioned normal operation of an image pick-up tube would become impossible. As a means for improving the landing characteristics of the electron beam by reducing the secondary electron emission ratio of the scanning-side surface, therefore, a method has been suggested for forming an electron beam landing layer of porous $Sb_2S_3$ on the scanning-side surface of the target by vapor deposition in an inert gas (JP-A-52-40809).

Further, in order to produce an output signal of a high S/N ratio by dampening the spurious signals which otherwise might be generated by an extra return electron beam being reflected on the in-tube electrode and re-entering the target during the scanning of the electron beam in these image pick-up tubes, a method has been disclosed for providing an additional electrode outside the electron beam scanning region on the scanning-side surface of the target (JP-A-61-31349), or separating the transparent conductive film on the light entrance side of the target into two parts corresponding to the effective scanning region of the electron beam and the remaining region, which are controlled by being connected to independent power supplies respectively (JP-A-63-72037).

If the photoconductive film of the target section is to be thickened for improving the sensitivity or reducing the capacitive lag or if an avalanche multiplication is to be caused in the photoconductive film for further improving the sensitivity of these conventional image pick-up tubes, it is necessary to increase the voltage between the target electrode and the cathode of the image pick-up tube (hereinafter referred to as "the target voltage").

With the increase in target voltage, however, the impinging energy of scattered electrons is increased, increasing the secondary electron emission ratio to more than unity, with the result that the scanning-side surface potential outside the scanning region would begin to increase beyond the target potential. This increase in surface potential, which further facilitates the emission of secondary electrons, would steadily increase the scanning-side surface potential outside the scanning region until it is balanced with an electrode potential higher than the target potential, for example, a mesh electrode potential. An increase in the scanning-side surface potential outside the scanning region would affect the track of a scanning electron beam scanning the peripheral parts of the scanning region, thereby preventing the scanning electron beam from entering the target in perpendicular direction. As a consequence, the emission of secondary electrons by the scanning electron beam would be increased around the scanning region, and the resulting unstable scanning would cause what is called "the waterfall effect" on the screen or an inversion phenomenon by transfer to a high-speed scanning.

As mentioned above, the phenomenon of waterfall or inversion is a fault attributable to the unstable operation caused by the increase in the scanning-side surface potential outside the effective scanning region which will occur in the case where the target voltage or mesh voltage is increased in operation.

The cause of the waterfall phenomenon will be described more in detail with reference to the partly cutaway sectional view of the parts in the vicinity of the target section of an image pick-up tube shown in FIG. 1A and a photoconductive film and the diagram of surface potential distribution thereof shown in FIG. 1B The surface potential within the scanning region is rendered substantially equal to the cathode potential by the scanning beam as shown in FIG. 1B. The potential outside the scanning region, on the other hand, is equal to the target voltage applied to. When stray electrons (called return beam) enter the area outside the scanning region and the surface secondary electron emission ratio exceeds unity as compared with the value within the scanning region, the surface potential thereof gradually increases under the effect of the voltage of the mesh electrode in the vicinity thereof until finally it is balanced with the mesh voltage. As a result, the surface potential is increased from the original level, thus further aggravating the waterfall.

In order to solve this problem, the entire area of the film on the electron beam scanning side of the target section may be composed of a material high in the degree of porosity as shown in FIG. 2A or the thickness of the $Sb_2S_3$ may be increased, thus eliminating the waterfall phenomenon as is clear from the mark Δ in FIG. 2B, although the lag characteristic is deteriorated.

As will be seen from the foregoing description, the use of an image pick-up tube with a high target voltage is liable to cause an abnormal pattern changing like a ripple around the reproduction screen of the monitor (hereinafter referred to merely as "the waterfall phenomenon") or the polarity inversion of a signal output of an image pick-up tube at a part corresponding to the peripheral parts of the screen (hereinafter referred to merely as "the inversion phenomenon"), thereby making it impossible to obtain a satisfactory image. A conventional method for dampening the generation of these faulty phenomena has been by increasing the degree of porosity or film thickness of an image pick-up tube having an electron beam landing layer of porous $Sb_2S_3$. This method, however, has a disadvantage in that the resistance of the electron beam landing layer increases resulting in an increased lag.

SUMMARY OF THE INVENTION

Accordingly, it is the object of the present invention to provide an image pick-up tube comprising a target section by which the above-mentioned adverse phenomena can be prevented to produce a satisfactory image quality stably without deterioration of the characteristics including the lag even when the target voltage is increased.

According to one aspect of the present invention, there is provided an image pick-up tube wherein a secondary electron emission dampening layer is formed at least in a part of the area outside the effective scanning region of the electron beam scanning-side surface of the target whereby the secondary electron emission ratio of the entire area or a part thereof outside the effective scanning region is reduced below that within the effective scanning region.

According to another aspect of the present invention, as found by the inventors, although the surface of the effective electron beam scanning region of the target may be constructed as in the prior art, the waterfall or inversion phenomenon can be dampened by reducing the secondary electron emission ratio of at least a part of the area outside the effective scanning region as compared with that within the effective scanning region.

According to still another aspect of the present invention, there is provided an image pick-up tube and a method of fabrication thereof, in which at least a part of the area outside the effective scanning region of the surface on the electron beam scanning side of the target section of an image pick-up tube is made of a material larger in grain size than within the effective scanning region thereof or the film thickness thereof is increased and/or at least a part of the area outside the effective scanning region is formed of a thin film made of a specific element thereby to make up a target as a secondary electron emission dampening layer.

BRIEF DESCRIPTION OF THE DRAWINGS

FIGS. 5A to 5F are diagrams for explaining fabrication processes of a second example of target construction employed in FIGS. 3A and 3B.

FIGS. 8A to 8G are diagrams for explaining the fabrication processes of a fourth example of target construction employed in FIGS. 3A and 3B.

FIGS. 13A to 13R are diagrams showing processes of forming a target according to the fourth embodiment shown in FIGS. 12A and 12B.

FIG. 14 is a plan view showing a target form according to a fifth embodiment of the present invention.

DESCRIPTION OF THE PREFERRED EMBODIMENTS

Figure 1A:
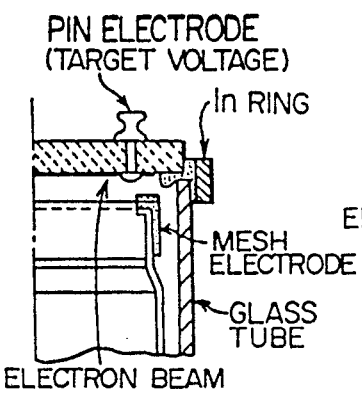
FIGS. 1A and 1B are a sectional view of a target section of a conventional image pick-up tube and a diagram showing a surface potential distribution thereof respectively.
Figure 1B:
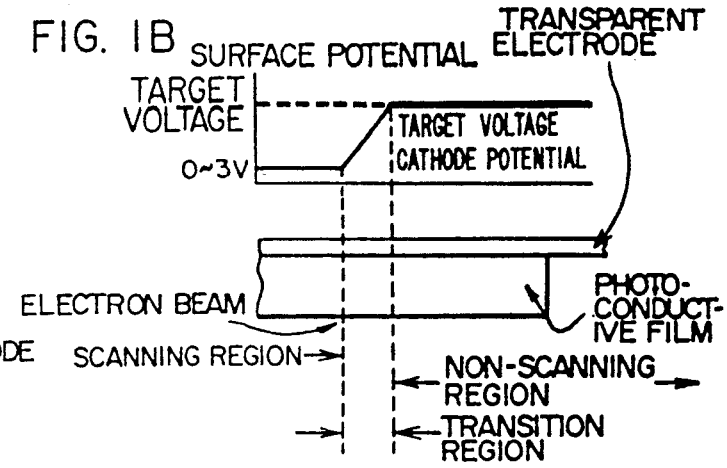
Figure 2A:
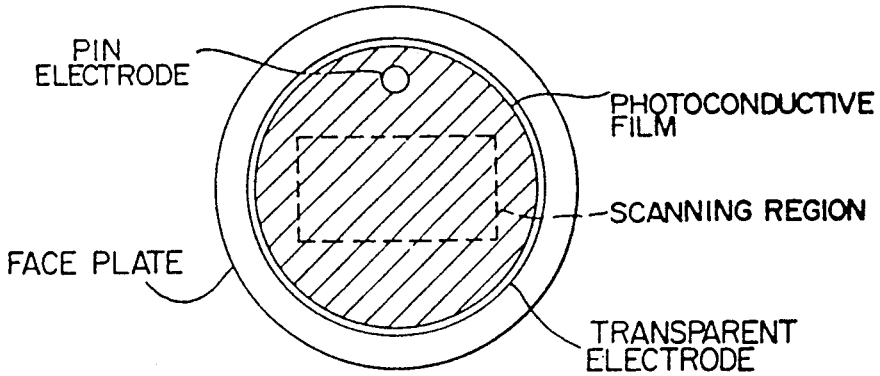
FIGS. 2A and 2B are diagrams showing the surface on the electron beam scanning side of a target of a conventional image pick-up tube and an example of waterfall/lag/film thickness characteristics thereof respectively.
Figure 2B:
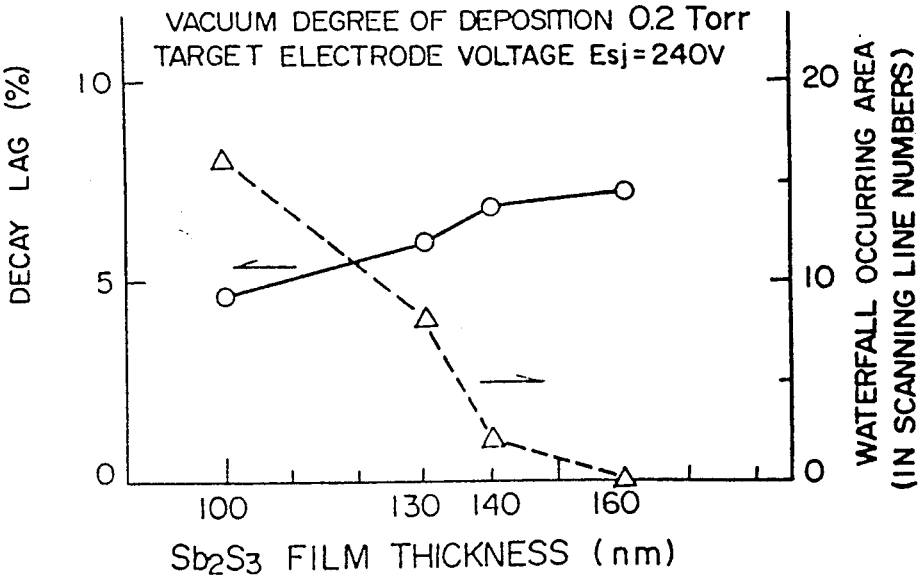
Figure 3A:
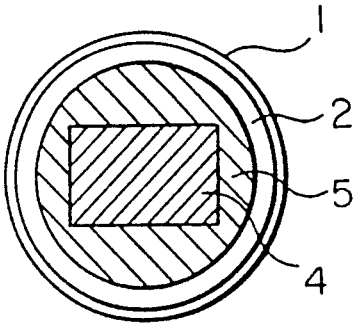
FIGS. 3A and 3B are diagrams showing the surface on the electron beam scanning side of a target section of an image pick-up tube according to the present invention and a longitudinal sectional view of an image pick-up tube employing such a target respectively.
Figure 3B:
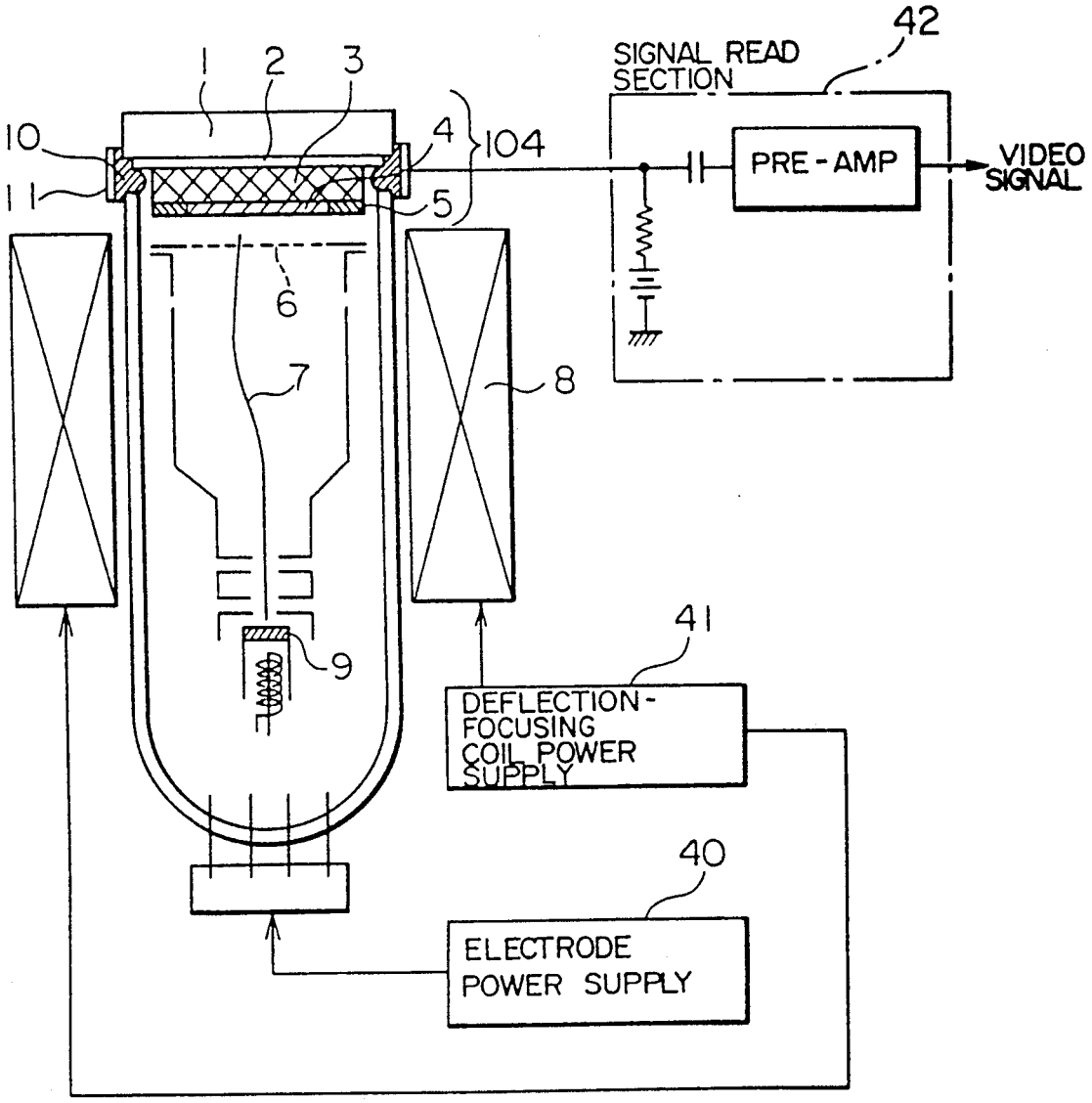

An embodiment of the present invention will be explained below with reference to the drawings. A construction of an image pick-up tube according to an embodiment of the present invention is schematically shown in FIGS. 3A and 3B. FIG. 3A is a plan of the target surface of an image pick-up tube as viewed from the electron beam scanning side, and FIG. 3B a sectional view showing the essential parts of an image pick-up tube schematically. This image pick-up tube has a target section comprised of a transparent substrate 1, a transparent conductive film 2, a photoconductive film 3, an electron beam landing layer 104, an indium metal 10 in contact with the transparent conductive film 2 and a metal ring 11. The electron beam landing layer 104 is divided into a scanning-side surface layer within the effective scanning region scanned by an electron beam (hereinafter referred to merely as "the surface area within the effective scanning region" for simplicity's sake) 4 and a scanning-side surface layer outside the effective scanning region (hereinafter referred to merely as "the surface area outside the effective scanning region" for simplicity's sake) 5.

An electromagnetic coil 8 for deflecting and focusing an electron beam is included in a deflection-focusing section, and a cathode 9 for emitting an electron beam 7 and a mesh electrode 6 provide an electrode section. A video signal is taken out of the metal ring and produced through a signal reading section 42 including a coupling capacitor and a pre-amplifier. The cathode 9 and the mesh electrode 6 are supplied with a desired operating voltage from a predetermined electrode power supply 40. Similarly, the electromagnetic coil 8 is supplied with an appropriate deflection-focusing voltage from a deflection-convergence coil power supply 41 for causing the electron beam 7 to scan the surface area 4 within the effective scanning region.

A method of fabricating a first construction of the target section of an image pick-up tube shown in FIGS. 3A and 3B will be explained with reference to FIGS. 4A to 4F sequentially.

Figure 4A:
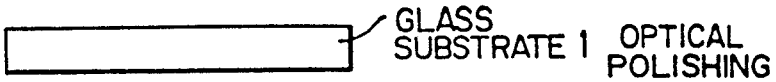
FIGS. 4A to 4F are diagrams for explaining processes of fabrication of a first example of target construction employed in FIGS. 3A and 3B.
Figure 4B:
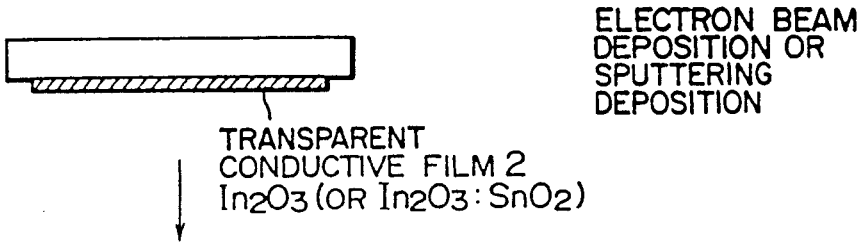
Figure 4C:
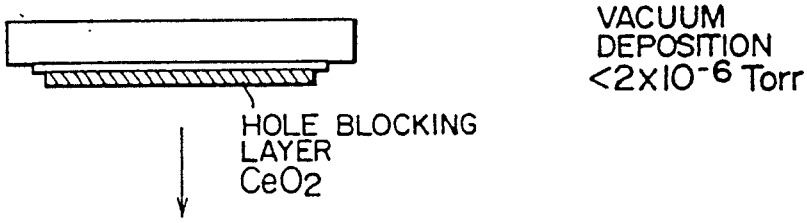
Figure 4D:
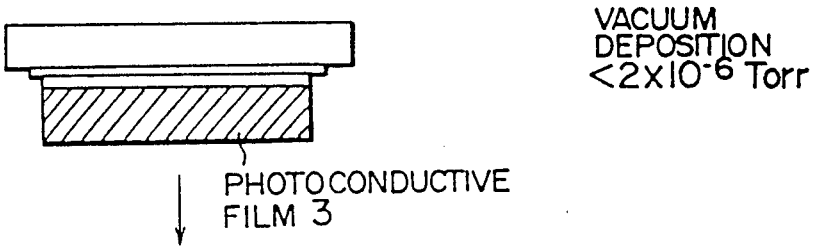
Figure 4E:
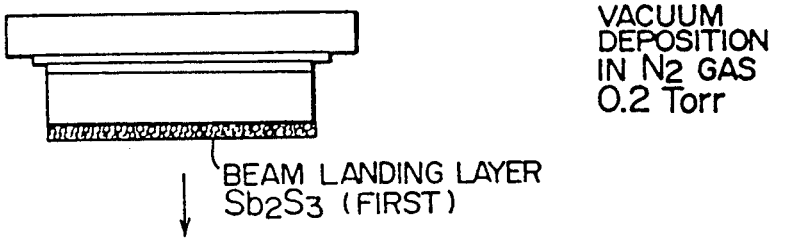
Figure 4F:
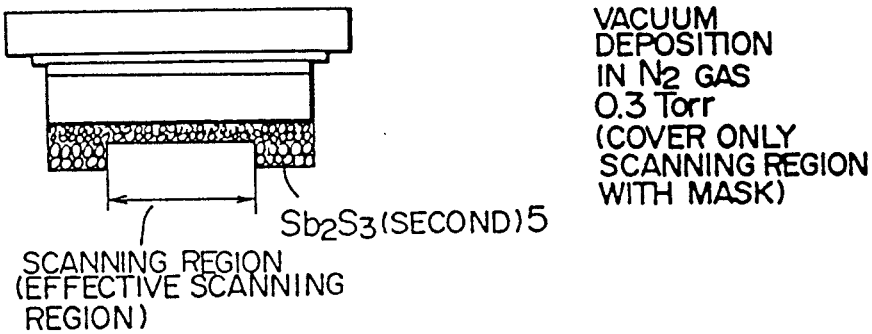
Figure 4G:
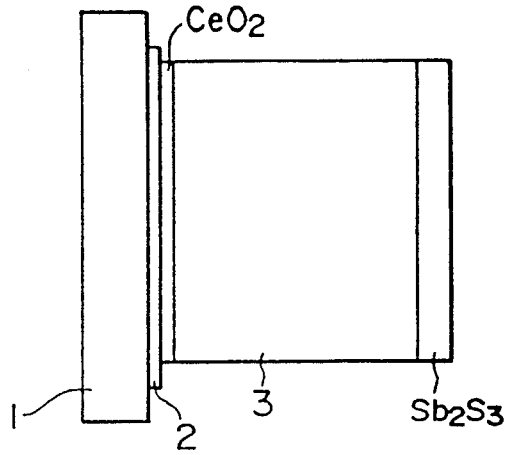
FIG. 4G shows an embodiment of a sectional view of a target portion.
Figure 4H:
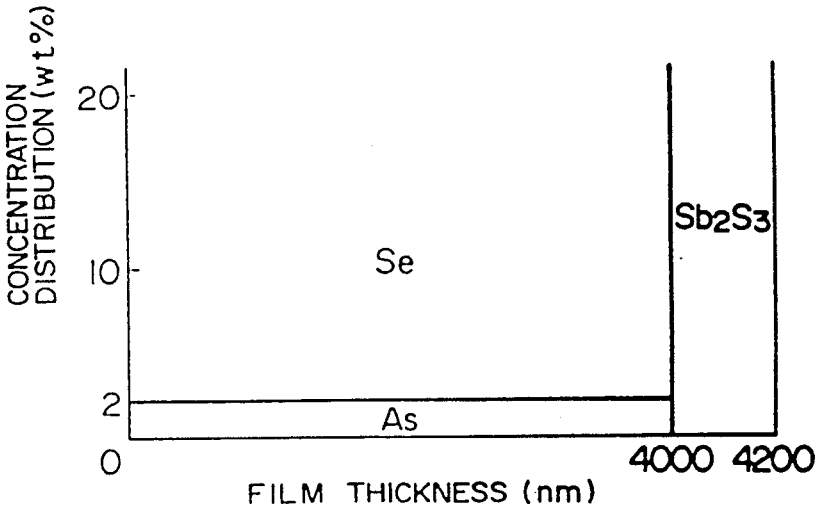
FIG. 4H shows an embodiment of a photoconductive film.
Figure 4I:
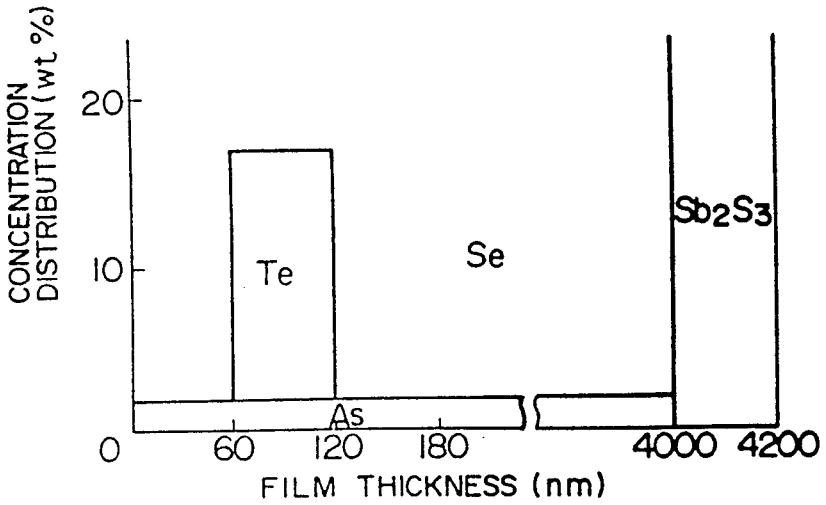
FIG. 4I shows another embodiment of photoconductive film, FIGS. 4J, K show a secondary electron emission ratio/lag characteristics.

A transparent conductive film 2 made of an indium oxide as a main component thereof is formed on a transparent glass substrate 1 (FIG. 4A) as large as 26 mm in diameter by the electron beam deposition process or the sputtering deposition process (FIG. 4B). The resulting assembly has formed thereon by vacuum deposition a hole blocking layer 0.02 μm thick made of cerium oxide, and a photoconductive film 3 which is 4 to 10 μm thick and made of Se, As and Te sequentially (FIGS. 4C, 4D), followed by forming an $Sb_2S_3$ layer in two steps by evaporation. A structure of the target portion is described according to FIGS. 4G, 4H, 4I hereinbelow. A sectional view of the target portion in the direction of thickness of the film is shown in FIG. 4G, and an embodiment of photoconductive film is shown in FIG. 4H. In this embodiment, As is uniformly deposited by 2 wt % in the direction of thickness of the film. In another embodiment, as shown in FIG. 4I, Te of 60 nm is deposited in a region in close proximity to transparent conductive film 2 by density of 15 wt %. In the first step, $Sb_2S_3$ is deposited by evaporation in an nitrogen gas atmosphere 0.2 Torr in pressure thereby to form a porous $Sb_2S_3$ layer 0.1 μm thick over the entire surface of the photoconductive film (FIG. 4E). The second step has as mask opposed to the area corresponding to the effective scanning region of the electron beam and deposits $Sb_2S_3$ in a nitrogen gas atmosphere of 0.3 Torr. Thus a porous $Sb_2S_3$ layer 0.2 μm in thickness is formed only in the area corresponding to the outside of the effective scanning region on the photoconductive film, thereby producing a target of an image pick-up tube (FIG. 4F).

The first setp of $Sb_2S_3$ deposition forms a porous layer made of $Sb_2S_3$ of comparatively small grain size over the entire surface on the electron beam scanning side. In the second deposition step, a porous layer consisting of $Sb_2S_3$ comparatively large in grain size is superposed only on the surface area 5 outside the effective scanning region, thus constructing an electron beam landing layer including a surface area 4 within the effective scanning region of a porous layer small in grain size and a surface area 5 outside the effective scanning region larger in grain size making up a secondary electron emission dampening layer. In the electron beam landing layer of the target thus constructed, it has been confirmed that the secondary electron emission ratio of the surface area 4 outside the effective scanning region is smaller than that for the surface area 4 within the effective scanning region for the size of grains (the size of grain outside the effective scanning region is preferably among 200 nm–1,000 nm) making up respective porous layer. In this embodiments, as seen from FIGS. 4E and 4F, the fact that the surface area 5 outside the effective scanning region is formed thicker than the surface area 4 within the effective scanning region also contributes to lower the secondary electron emission ratio.

Figure 4J:
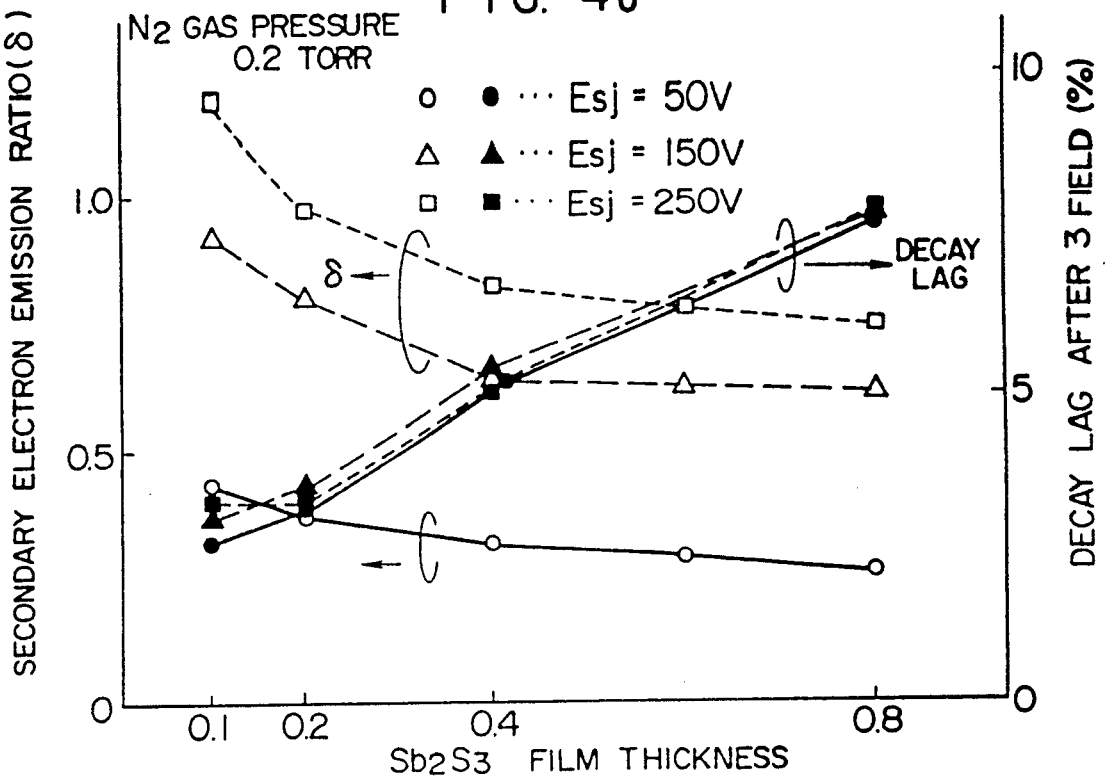
FIG. 4L shows a relation between a gas pressure and a grain size in vapour deposition.

A relation among a secondary electron emission ratio, a film thickness outside the effective scanning region and the size of grain is described hereinbelow. In FIG. 4J, a secondary electron emission ratio/lag characteristics under a constant porosity (by taking constant $N_2$ gas pressure during a vapour deposition), while thickness of film is changed. A secondary electron emission ratio δ is far below 1 when the target voltage (Esj) s around 50 V which is a normal operating condition of prior image pick up tubes, the secondary electron emission ratio δ increases as the target voltage is increased to operate in high sensitivity, and the ratio δ exceeds 1 between a range of 0.1–0.2 μm thick of $Sb_2S_3$ film. Although δ becomes small as the thickness of $Sb_2S_3$ film is increased, a lag characteristic (after 3 fields) becomes worse.

Figure 4K:
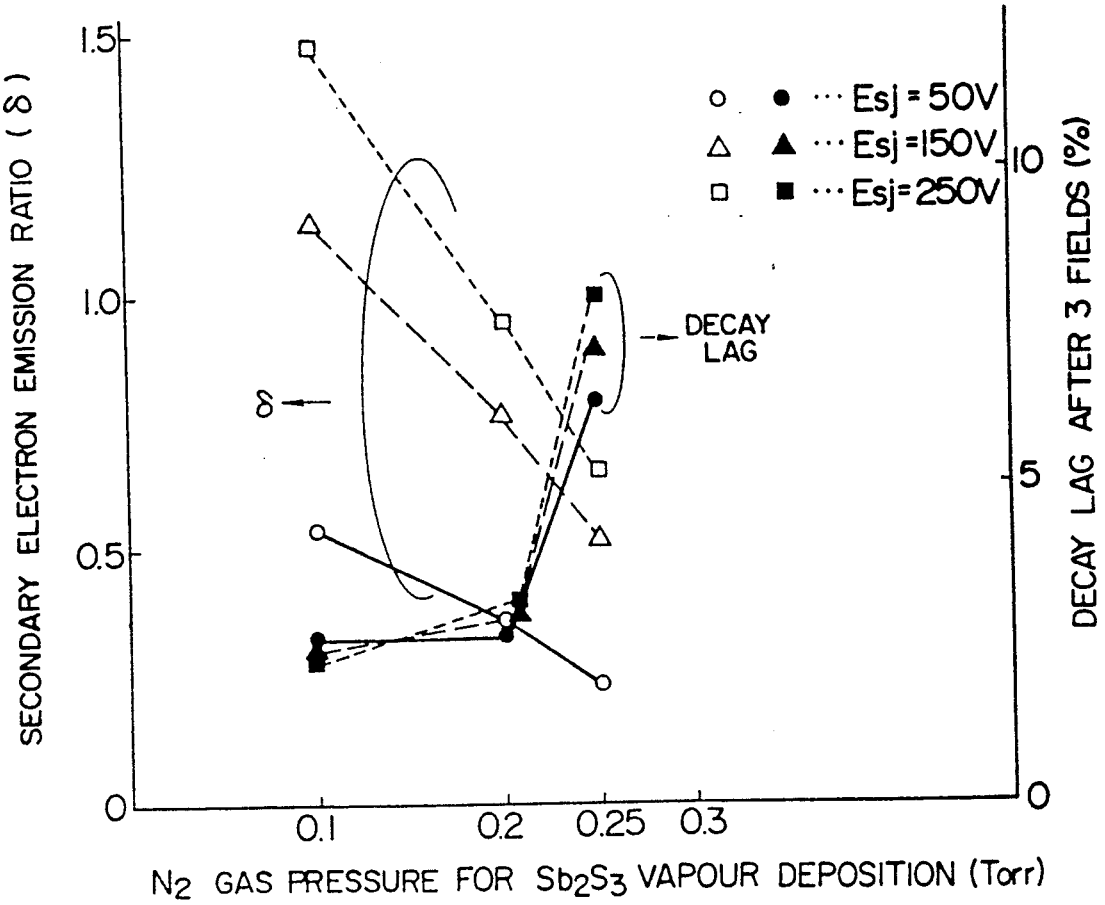
Figure 4L:
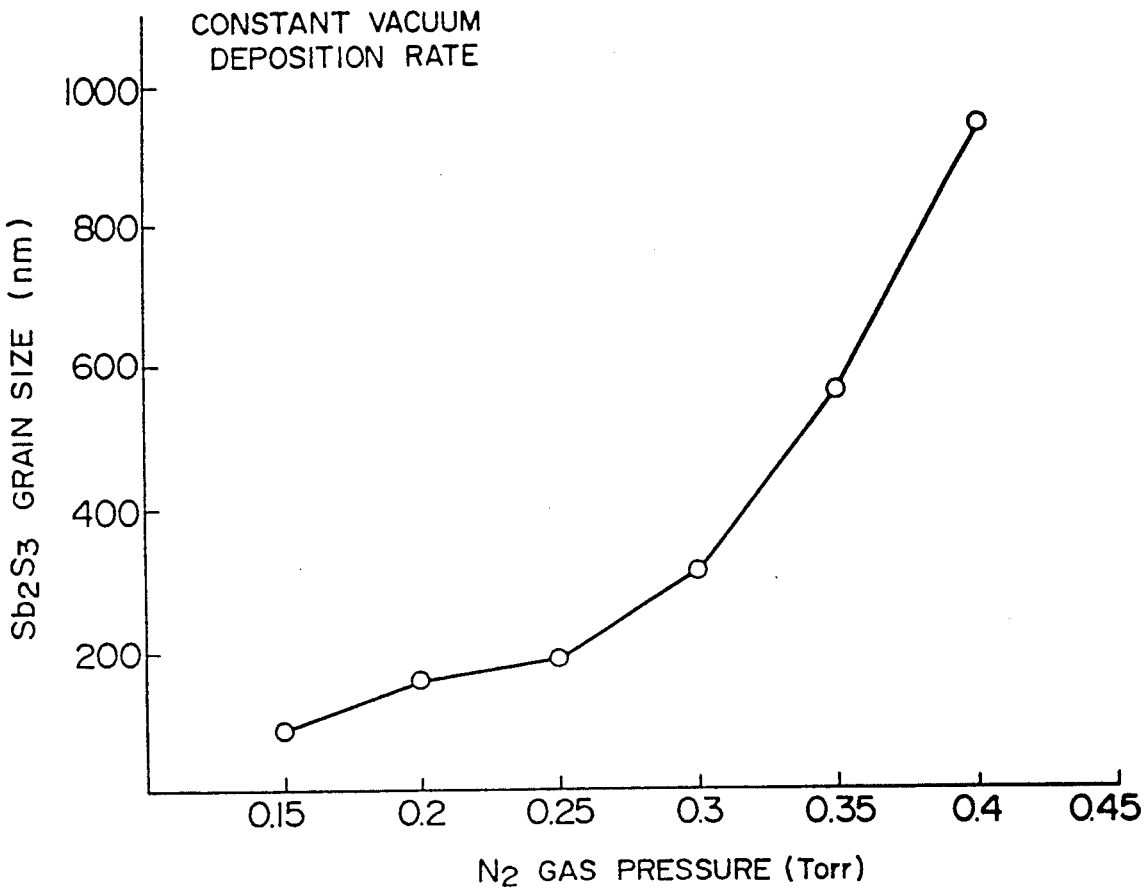

While in the FIG. 4K, there is disclosed a secondary electron emission ratio/lag characteristics under a change of porosity ($N_2$ gas pressure is changed during $Sb_2S_3$ vapour deposition). Though the secondary electron emission ratio is decreased as the porosity is increased, the lag characteristics is degraded. In FIG. 4L, a relation between a gas pressure in vapour deposition and a grain size of deposited layer is shown.

The secondary electron emission ratio a under the operating voltage does not exceed 1 within or outside the effective scanning region, and is defined as $$a = \frac{\text{Secondary electron emission ratio outside effective scanning region}}{\text{Secondary electron emission ratio within effective scanning region}}$$

This value should be in the range satisfying $1 > a > 0.2$ or more preferably $0.8 > a > 0.2$.

A second example of target construction is shown in FIGS. 5A to 5F.

A transparent glass substrate (FIG. 5A) of 26 mm in diameter has formed thereon a transparent conductive film and a photoconductive film of Se, As and Te (FIGS. 5B to 5D) in the same manner as in the first example of construction described above. The resulting assembly has formed thereon a porous $Sb_2S_3$ layer 0.1 μm in thickness by evaporation in a nitrogen gas atmosphere of 0.2 Torr in pressure (FIG. 5E). This process is followed by forming a C thin film 0.01 μm thick by sputtering evaporation within an argon gas 0.01 Torr in pressure thereon (FIG. 5F). In the process, C thin film is deposited by sputtering with a mask opposed to the effective scanning region of electron beam. Thus a C thin film is formed only at parts corresponding to the surface area outside the effective scanning region, so that a secondary electron emission stop layer is constructed of the $Sb_2S_3$ layer and the part deposited with the C thin film.

A target of an image pick-up tube of the first or second example of construction formed in the manner mentioned above is coupled to the image pick-up tube housing built in with an electron gun through indium, and the interior thereof is sealed in vacuum thereby to make up a photoconductive-type image pick-up tube. As a result of mounting on a TV camera and operating the image pick-up tube fabricated in the manner mentioned above, we could produce a stable and satisfactory image with low lag and high sensitivity without any waterfall or inversion phenomenon even at a target voltage of 400 V.

Now, a third example of target construction will be explained with reference to FIGS. 6A to 6E and FIG. 7.

Figure 7:
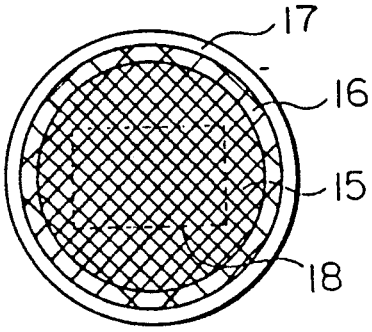
FIG. 7 is a schematic diagram showing a mesh structure used in the fabrication processes shown in FIGS. 6A to 6E.

A transparent glass substrate 18 mm in size (FIG. 6A) has formed thereon a translucent conductive film (FIG. 6B), a positive hole injection stop layer (FIG. 6C) and a photoconductive film (FIG. 6D) by the method mentioned in the first example of construction above. A mesh for controlling the amount of vapor deposition shown in FIG. 7 is arranged in close proximity to the photoconductive film surface and deposited by evaporation in a nitrogen gas atmosphere of 0.2 Torr in pressure thereby to form a central part 0.1 μm thick. The vapor deposition control mesh having mesh support 17 shown in FIG. 7 includes a low-transmittance mesh 15 with the central part thereof sufficiently large to cover the effective scanning region, and has a peripheral part thereof constructed of a high-transmittance mesh portion 16 four times higher in transmittance than the central part (for instance, 100–1,000 lines per inch in the central part and 25–250 lines per inch in the peripheral part). As a result, by using this vapor deposition process, the film thickness of the peripheral part is quadrupled, thus forming in a single vapor deposition step a porous $Sb_2S_3$ film making up a secondary electron emission stop layer having a peripheral part outside the effective scanning region smaller in secondary electron emission ratio than the effective scanning region. This target section is mounted on an image pick-up tube housing built in with an electron gun and the interior thereof is hermetically sealed in vacuum thereby to produce a photoconductive-type image pick-up tube. Although in this embodiment, a surface which does not emit secondary electrons easily is not placed all over, outside of the effective scanning region, but only in a peripheral portion outside of the effective scanning region, the image pick-up tube thus fabricated does not develop any waterfall or inversion phenomenon and produces an image of high quality when operated on a target voltage of 300 V.

Now, a fourth example of target construction suitable to the X-ray image pick-up tube will be explained with reference to FIGS. 8A to 8G.

A Be plate 0.5 mm thick and 26 mm in diameter is optically polished on one side thereof (FIG. 8A), germanium oxide and cerium oxide are deposited by evaporation in the thickness of 0.01 μm each as a hole blocking layer on the polished surface (FIGS. 8B and 8C), and Se containing 2% As is deposited by evaporation in the thickness of 20 to 30 μm (FIG. 8D). The resulting assembly has deposited CdTe by evaporation over the entire surface thereof in an argon gas atmosphere of 0.4 Torr in pressure thereby to form a porous film 1 μm thick (FIG. 8E). The assembly thus prepared is set in an ion etching device, and the part of CdTe corresponding to the effective scanning region is removed by plasma ion etching by use of a mask (FIG. 8F). Then, the assembly is transferred to an $Sb_2S_3$ vapor deposition device, and $Sb_2S_3$ is deposited by evaporation on the whole surface of the assembly in a nitrogen gas environment 0.2 Torr in pressure thereby to form a porous $Sb_2S_3$ film 0.3 μm thick (FIG. 8G). The component thus obtained is mounted on an image pick-up tube housing with a built-in electron gun thereby to complete an X-ray image pick-up tube. In this case, too, the surface area outside the effective scanning region functions as a secondary electron emission stop layer.

Figure 9A:
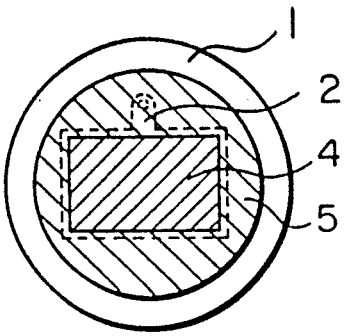
FIGS. 9A and 9B are a plan of a target form according to a second embodiment and a sectional view of the essential parts of an image pick-up tube employing the same respectively.
Figure 9B:
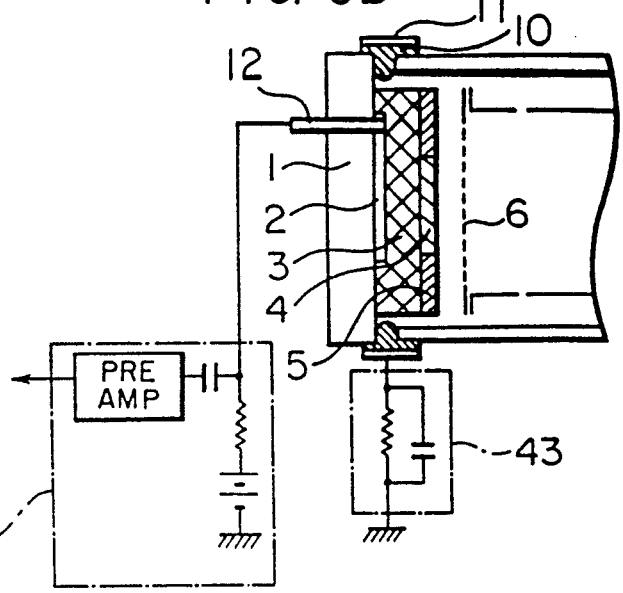

The transparent conductive film may not necessarily cover the entire surface of the substrate as in FIG. 3 but may be applied only on the part corresponding to the effective scanning region on the electron beam scanning side. What is required is to make sure that the secondary emission ratio at the part corresponding to the surface area outside the effective scanning region of the target is smaller than that of the effective scanning region. In FIGS. 9A and 9B, the size of the transparent conductive film is minimized and a signal output is taken out from a signal pin electrode 12, and therefore a high S/N ratio is attained with a small stray capacity of the signal electrode and waterfall and inversion phenomenon suppressed.

According to the embodiment shown in FIGS. 9A and 9B, a signal output is read out of a signal read section 42 through the pin electrode 12, and the metal ring is grounded through an earth circuit 43.

FIGS. 10A to 10H illustrate a method of fabricating the target of FIGS. 9A and 9B.

Figure 10A:
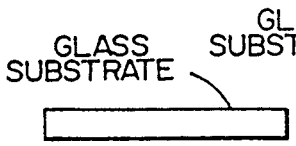
FIGS. 10A to 10P are diagrams showing processes of forming a target according to a second embodiment shown in FIGS. 9A and 9B.
Figure 10B:
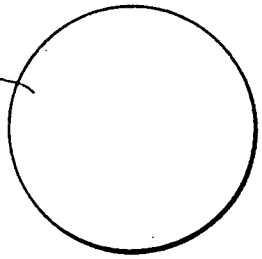
Figure 10C:
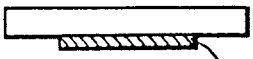
Figure 10D:
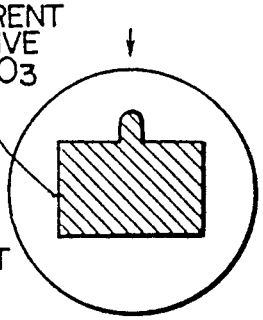
Figure 10E:
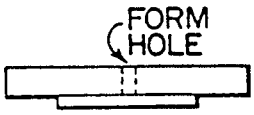
Figure 10F:
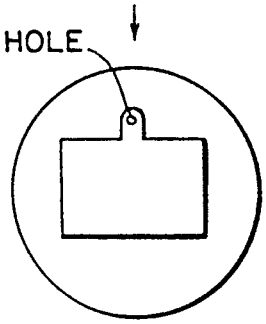

A substrate is made of transparent glass $\frac{3}{8}$ inch in diameter, and a rectangular transparent conductive film is formed thereon with indium oxide by sputtering through a mask (FIGS. 10C, D). The glass face plate is formed with a hole (FIGS. 10E, F) into which a signal pin electrode is inserted, and is soldered at an end of the indium oxide (FIGS. 10G, H). This face plate is formed with cerium oxide 0.02 μm thick as a hole blocking layer (FIGS. 10I, J), followed by the process of depositing by vacuum evaporation an amorphous photoconductive film 2 to 5 μm thick of Se-As 14 mm in diameter thereon (FIGS. 10K, L). The resulting assembly has deposited by evaporation thereon $As_2Se_3$ in a nitrogen gas environment 0.5 Torr in pressure thereby to form a porous $As_2Se_3$ film 0.1 μm thick (FIGS. 10M, N). During vapour deposition, the effective scanning region (6.6×8.8 mm) is covered by a mask to prevent deposition by $As_2Se_3$. An $Sb_2S_3$ film is then vapour deposited to an area of 14 mm Φ under 0. 2 Torr $N_2$ gas to deposit a porous $Sb_2S_3$ film of 0.1 μm thick (FIGS. 10O, P). And is coupled to the image pick-up tube housing with a built-in electron gun thereby to complete a photoconductive-type image pick-up tube.

This image pick-up tube was operated under a target voltage corresponding to an electric field intensity of $1.2\times10^8$ V/cm of the photoconductive film, thus producing an image of ultra-high sensitivity and high quality with waterfall and inversion phenomenon suppressed appropriately.

Also in this embodiment, the porous films of $As_2Se_3$ and $Sb_2S_3$ function as a secondary electron emission stop layer.

Figure 11A:
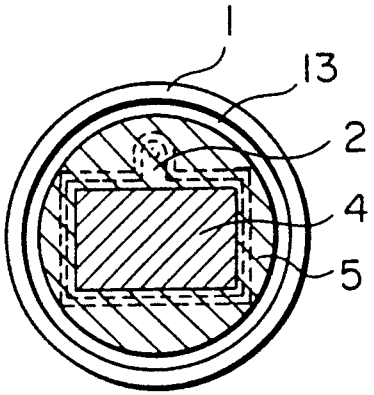
FIGS. 11A and 11B are a plan view showing a target form according to a third embodiment and a sectional view of the essential parts of an image pick-up tube using the same respectively.
Figure 11B:
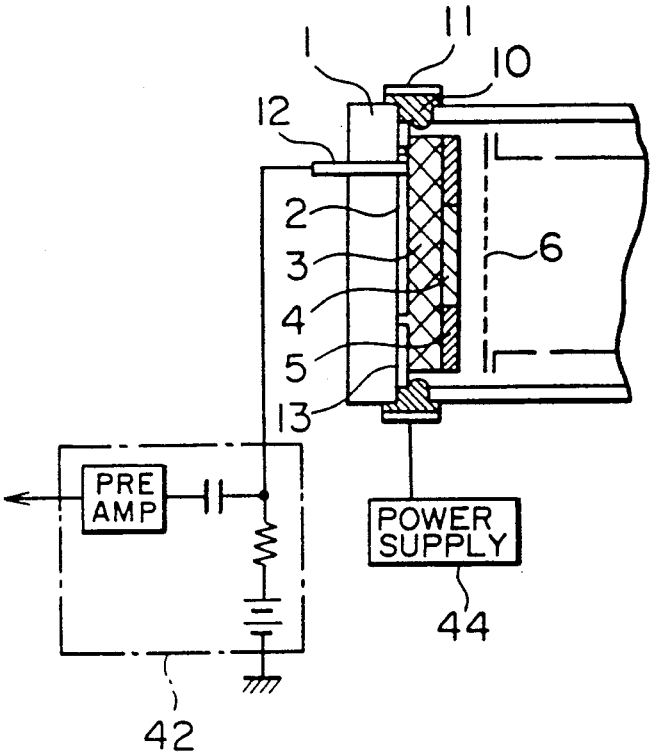
Figure 12A:
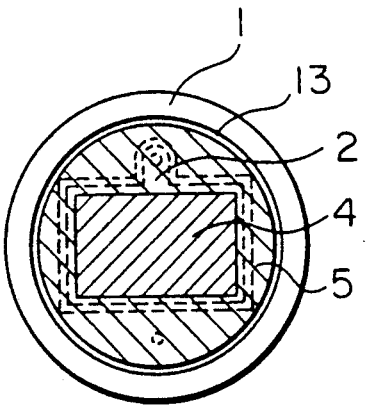
FIGS. 12A and 12B are a plan view showing a target form according to a fourth embodiment and a sectional view of the essential parts of an image pick-up tube employing the same respectively.

Other embodiments of the target section of an image pick-up tube according to the present invention are shown in FIGS. 11A, 11B and 12A, 12B. FIGS. 11A and 12A are plans of the target surface as viewed from the electron beam scanning side, and FIGS. 11B and 12B sectional views of a construction of an image pick-up tube using respective targets.

In these embodiments, a conductive film 2 between a substrate 1 and a photoconductive film 3 is formed as parts 2 and 13 independently insulated in opposed spaced relationship with the surface area 4 within the effective scanning region and the surface area 5 outside the effective scanning region of the electron beam respectively. The transparent conductive film portion 2 in opposed relationship with the surface area 4 within the effective scanning region is connected to a pin electrode 12 inserted through the substrate 1, and an output signal is read out through this pin electrode 12. Also, according to the embodiment of FIGS. 11A and 11B, the transparent conductive film portion 13 in opposed relationship with the surface area 5 outside the effective scanning region is connected to a metal ring 11 through an indium metal 10, which metal ring 11 is in turn connected with a power supply 44.

Figure 12B:
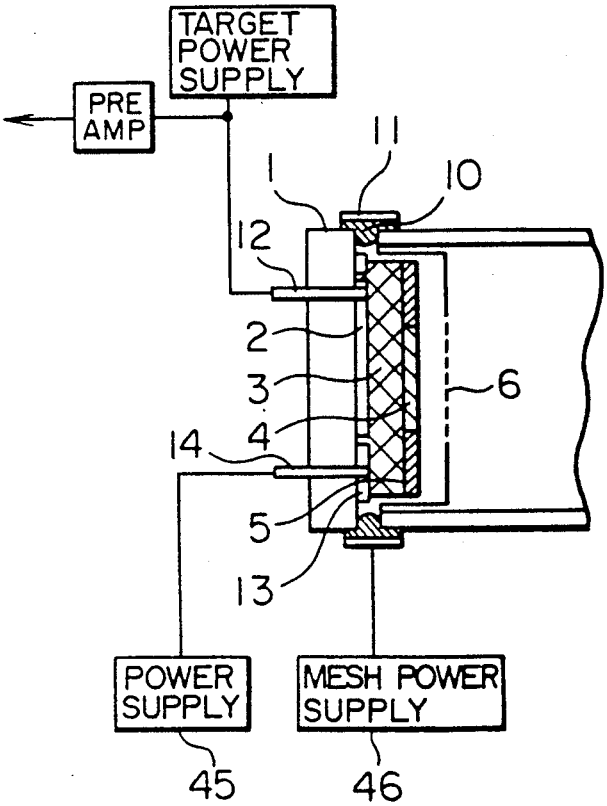
Figures 13K, 13L, 13M, 13N, 13O, 13P, 13Q, 13R, 14:
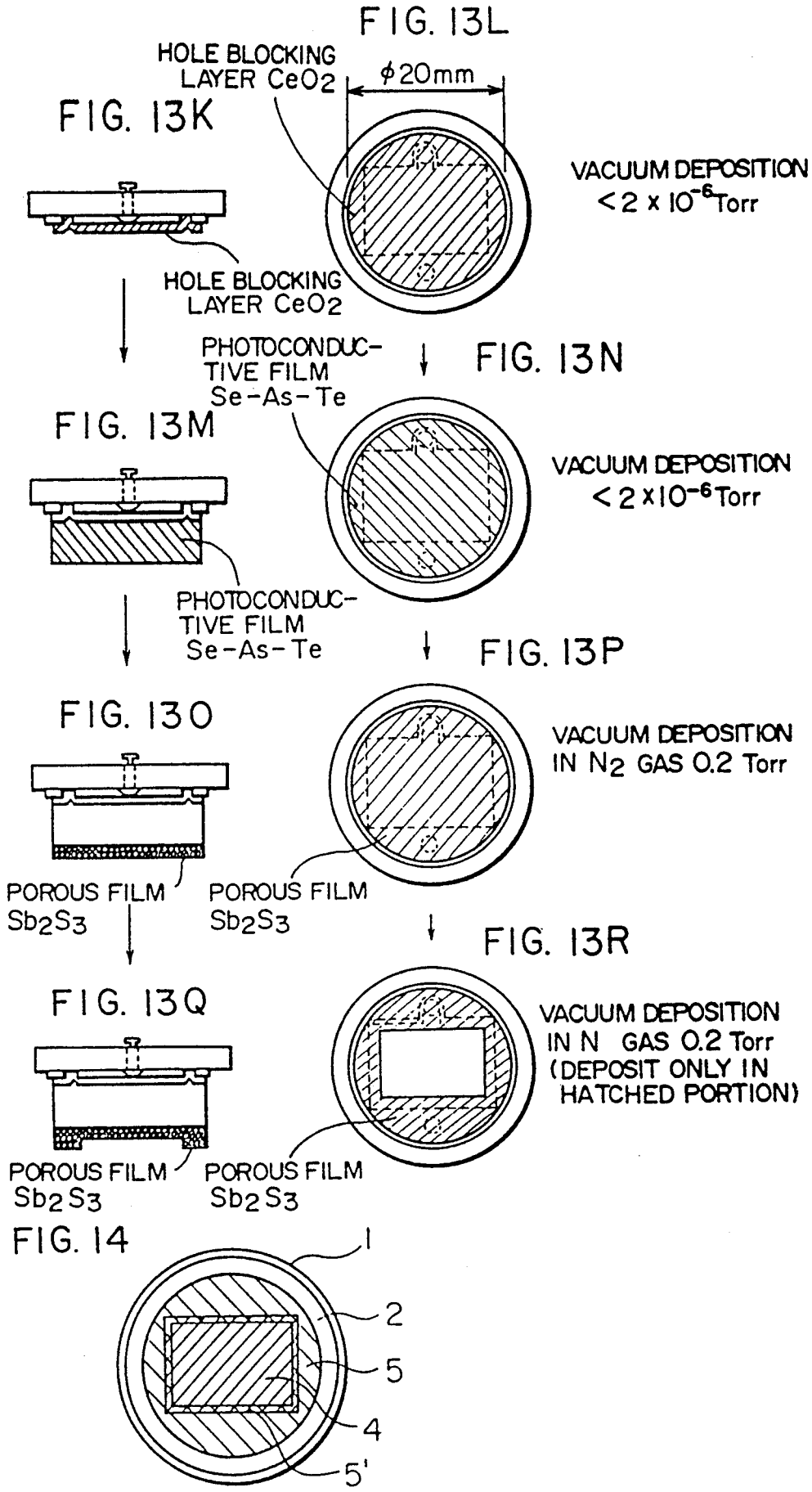

In the embodiment shown in FIGS. 12A and 12B, on the other hand, a transparent conductive film portion 13 in opposed relationship with the surface area 5 outside the effective scanning region is connected with a pin electrode 14 passed through the substrate 1, which pin electrode 14 is in turn connected with a power supply 45. The beam scanning-side surfaces 4 and 5 of these targets may be of any of the target constructions employed in FIGS. 3A, 3B or 9A, 9B mentioned above. Further, according to the embodiment under consideration, the portion 13 of the transparent conductive film opposed to the surface area 5 outside the effective scanning region is connected with the power supplies 44, 45 thereby to supply the portion 13 with an independent voltage lower than the target power supplied to the portion 2 in opposed relationship with the surface area 4 within the effective scanning region. As a result of this construction, the potential at the surface area 5 outside the effective scanning region of the electron beam scanning surface is kept lower than the potential at the surface area 4 within the effective scanning region. This configuration keeps the potential at the surface area outside the effective scanning area lower than that at the surface area 4 within the effective scanning region, thus functioning as a secondary electron emission stop layers. In this case, waterfall and inversion phenomenon are remarkably dampened. Further, if the transparent conductive film portion 13 opposed to the surface area outside the effective scanning region while connected with another power supply as mentioned above, the light entering the surface area 5 outside the effective scanning region is masked, promoting the effect of dampening waterfall and the inversion phenomenon even more. The embodiments of FIGS. 12A and 12B further comprises a mesh power supply 46 for supplying a predetermined voltage to the mesh 6 through the metal ring 11 thereby to facilitate independent control of the mesh voltage. The embodiments explained with reference to FIGS. 11A, 11B and FIGS. 12A, 12B have only a difference therebetween whether one or two pins 12, 14 are used in the aspect of fabrication, and therefore a method of fabrication of target section employed in the embodiment of FIGS. 12A, 12B will be explained below as an illustration with reference to FIGS. 13A to 13R.

A transparent glass substrate 1 inch in diameter has formed thereon an electrode corresponding to a conductive film 13 of Cr-Au by mask vapor deposition (FIGS. 13A to 13D). A transparent conductive film 2 with indium oxide as a main component is then formed by use of a mask by sputtering (FIGS. 13E to 13F). The glass face plate is then formed with a hole (FIGS. 13G and 13H), through which a pin electrode 12 and a pin electrode 14 are inserted and soldered to the transparent conductive film 2 and the conductive film 13 respectively (FIGS. 13I and 13J). A hole blocking layer (FIGS. 13K and 13L) made of cerium oxide 0.03 μm thick and an amorphous semiconductor film of Se, As and Te 2 to 6 μm thick (FIGS. 13M and 13N) are formed by vacuum deposition in an area 20 mm in diameter on the face plate. The resulting assembly has thereon deposited by evaporation $Sb_2S_3$ in a nitrogen gas atmosphere of 0.2 Torr in pressure thereby to form a porous $Sb_2S_3$ film 0.1 μm thick (FIGS. 13O and 13P). In the next step, the part corresponding to the effective scanning region is covered with a mask, and $Sb_2S_3$ is deposited by evaporation under the same conditions as above in the area outside the effective scanning region (FIGS. 13Q and 13R), thus bringing the total thickness of a porous $Sb_2S_3$ film to 0.2 μm in total. A unit thus obtained is coupled with an image pick-up tube housing with a built-in electron gun followed by vacuum sealing, thereby producing a photoconductive-type image pick-up tube.

In the embodiment explained in FIGS. 3A to 13R, the entire surface area 5 outside the effective electron-beam scanning region of the target is made up of a secondary electron emission stop layer so constructed that less secondary electrons are liable to be emitted therefrom than from the effective scanning region 4. Such a layer (surface portion) wherefrom secondary electrons are less liable to be emitted, however, is not necessarily extended over the entire surface 5 outside the effective scanning region. As shown by 5' of FIG. 14, for example, only that portion 5' of the surface area 5 outside the effective scanning region which is located in the vicinity of the surface area 4 of the effective scanning region may be constructed as a secondary electron emission stop layer wherefrom less secondary electrons are emitted with the same effect. In this way, waterfall and the inversion phenomenon are dampened with equal effect. The portion 5' of the surface area 5 outside the effective scanning region shown in FIG. 14 may be the same as that of the embodiments of the surface area 5 outside the effective scanning region explained above.

In order to reduce the secondary electron emission ratio of the surface area 5 outside the effective scanning region against that of the surface area 4 within the region of the electron beam scanning surface of the target as explained above, $Sb_2S_3$ is evaporated in an inert gas environment of $1\times10^{-1}$ Torr or higher pressure thereby to form a porous thin film of a lower filling rate (larger grain size) than the surface area 4 within the scanning region at a part corresponding to the surface area 5 outside the scanning region on the photoconductive film 3, as shown in the embodiments of FIGS. 4A to 4F, FIGS. 5A to 5F and FIGS. 8A to 8G, thus making up a secondary electron emission dampening layer. The secondary electron emission ratio may be reduced either by reducing the filling rate of the surface area 5 outside the effective scanning region with an increased inert gas pressure for evaporation or by increasing the thickness of the porous film. Materials of the porous thin film of which the filling rate or film thickness is adjustable between the surface area 4 inside the effective scanning region and the surface area 5 outside the effective scanning region include, in addition to those described above for the fabrication processes, any of compounds consisting of at least one of the elements Zn, Cd, Ga, In, Si, Ge, Sn, As, Sb and Bi and at least one of the elements S, Se and Te. The secondary electron emission ratio between the surface area 4 within the effective scanning region and the surface area 5 outside the effective scanning region made up of these compounds may be adjusted by making variable the thickness of the portions 4 and 5 of the porous film made of the above-mentioned material formed by evaporation in an inert gas or the inert gas pressure at the time of evaporation. Further, a plurality of porous thin films in lamination comprised of any of the compounds mentioned above may be used.

As an alternative method, as shown in FIG. 5F, a thin film of C which is not liable to emit secondary electrons may be formed on the surface area 5 outside the effective scanning region, or a porous thin film of high filling rate may be formed for improving the beam landing characteristic on the surface area 4 inside the effective scanning region as mentioned above, followed by forming a thin film shown in FIG. 5F to further dampen the emission of secondary electrons.

Figure 6A:
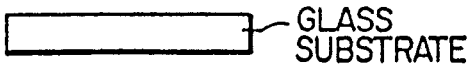
FIGS. 6A to 6E are diagrams for explaining fabrication processes of a third example of target construction employed in FIGS. 3A and 3B.
Figure 6B:
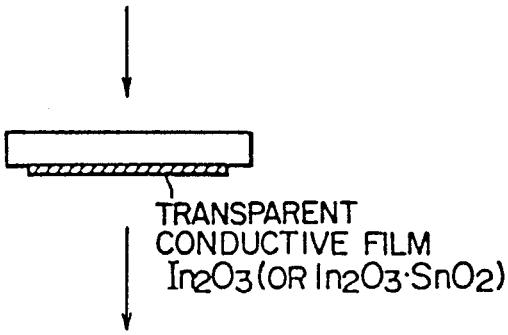
Figure 6C:
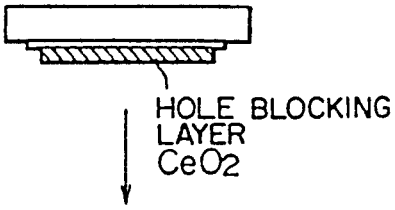
Figure 6D:
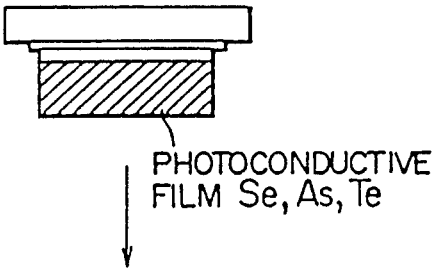
Figure 6E:
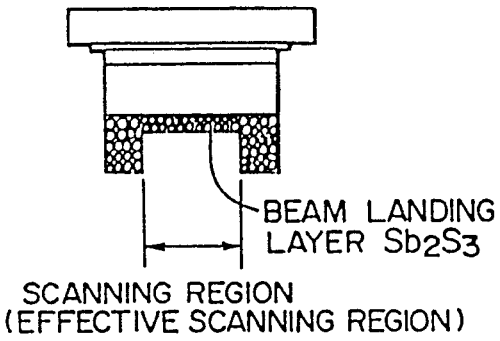

Effective methods of forming a secondary electron emission dampening layer small in secondary electron emission ratio on at least a part of the surface area 5 of the effective scanning region of the electron beam of the target surface include depositing by evaporation only at a predetermined part using a mask as shown in FIG. 4F, depositing by evaporation through a metal mesh for vapor deposition control which has a transmittance lower at a part thereof opposed to the effective scanning region of electron beam than at other parts thereof as shown in FIG. 6E, and forming a vapor-deposited film over the entire surface followed by removing the whole or part of at least the vapor-deposited material in the effective scanning region by plasma etching or other physical treatments. The method using a metal mesh requires only one vapor-depositing process and the ion-etching method has an advantage in that the film boundary may be processed with high accuracy.

The foregoing explanation relates mainly to an example of a photoconductive image pick-up tube using a transparent substrate as a target. The present invention may be applied with equal effect, however, also to an X-ray image pick-up tube comprising a photoconductive film formed on one side of a Be or Ti thin plate which is to be scanned by an electron beam. An X-ray image pick-up tube requires a thicker photoconductive film for higher target voltage in order to increase the amount of X-ray absorbed in operation, and therefore waterfall or inversion phenomenon may develop more easily. In spite of this, such adverse effects may be remarkably dampened by the present invention.

Furthermore, if the present invention is applied to various image pick-up tubes of internal multiplication type using a target voltage sufficiently high to cause avalanche multiplication within the photoconductive film, a very high sensitivity characteristic of an image pick-up tube is obtained with waterfall and inversion phenomenon suppressed.

The present invention, which imposes no limitations on the photoconductive film of the target of an image pick-up tube, is suitably used with various image pick-up tubes having different photoconductive films. The effect of the present invention is especially conspicuous if applied for improving the target voltage of an image pick-up tube of blocking type comprising a photoconductive film, at least a part of which is made of an amorphous semiconductor of Se or amorphous Si hydride as a main component.

According to the present invention, as shown in FIG. 3A, at least a part of the surface area outside the effective scanning region of the target surface is formed a secondary electron emission stop layer thereby to reduce the secondary electron emission ratio thereof lower than that of the surface area within the effective scanning region, so that less secondary electrons are emitted from the scanning-side surface outside the effective scanning region, with the result that the increase in the potential of the scanning-side surface outside the effective scanning region is controlled to dampen the waterfall or the inversion phenomenon.

Although the embodiments mentioned above handle an image pick-up tube having a scanning electron beam generation section of electromagnetic deflection and electromagnetic focusing type, the present invention is not necessarily limited to such type of image pick-up tube, but is applicable with equal effect also to the generally known electrostatic deflection and electromagnetic focusing type, electromagnetic deflection and electrostatic focusing type or electrostatic deflection and electrostatic focusing type of scanning electron beam generation unit.

Figure 15:
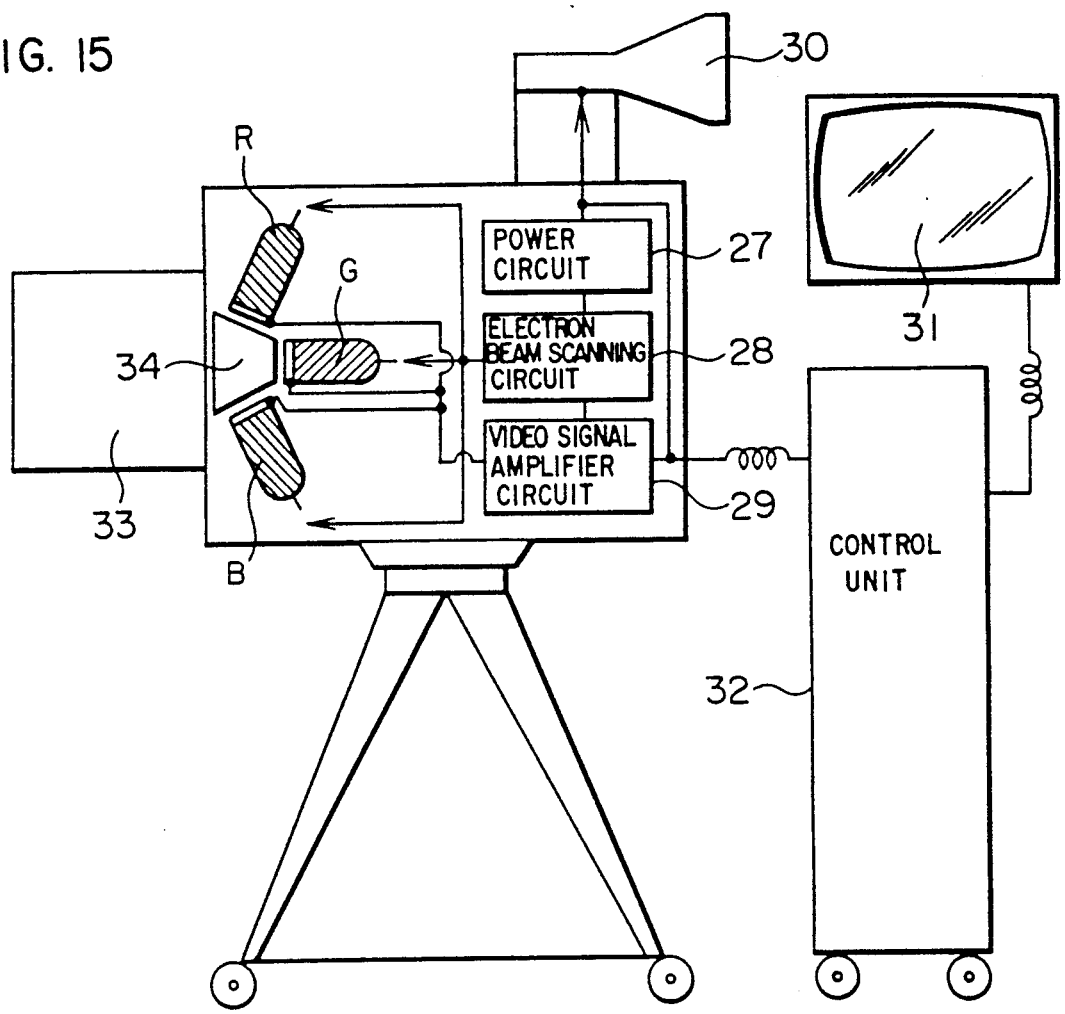
FIG. 15 is a diagram schematically showing a construction of a High-Definition TV camera employing an image pick-up tube fabricated according to the present invention.

FIG. 15 is a diagram schematically showing the main construction of a three-tube High-Definition color camera using an image pick-up tube according to the present invention. Characters R, G and B designate image pick-up tubes for R, G and B channels respectively, numeral 34 a color-separation optical system, numeral 27 a power circuit, numeral 28 an electron beam scanning circuit, numeral 29 a video signal amplifier circuit, numeral 30 a camera view finder, numeral 31 a video reproduction color monitor, numeral 32 a camera control unit, and numeral 33 a zoom lens. When each image pick-up tube was supplied from the power circuit with such a target voltage as to keep the electric field of the photoconductive film at $1.25\times10^6$ V/cm to operate with 1,125 scanning lines, we could obtain an ultra-high sensitive High-Definition TV image with a sensitivity more than ten times higher than the conventional video camera without any waterfall or inversion phenomenon.

Figure 16:
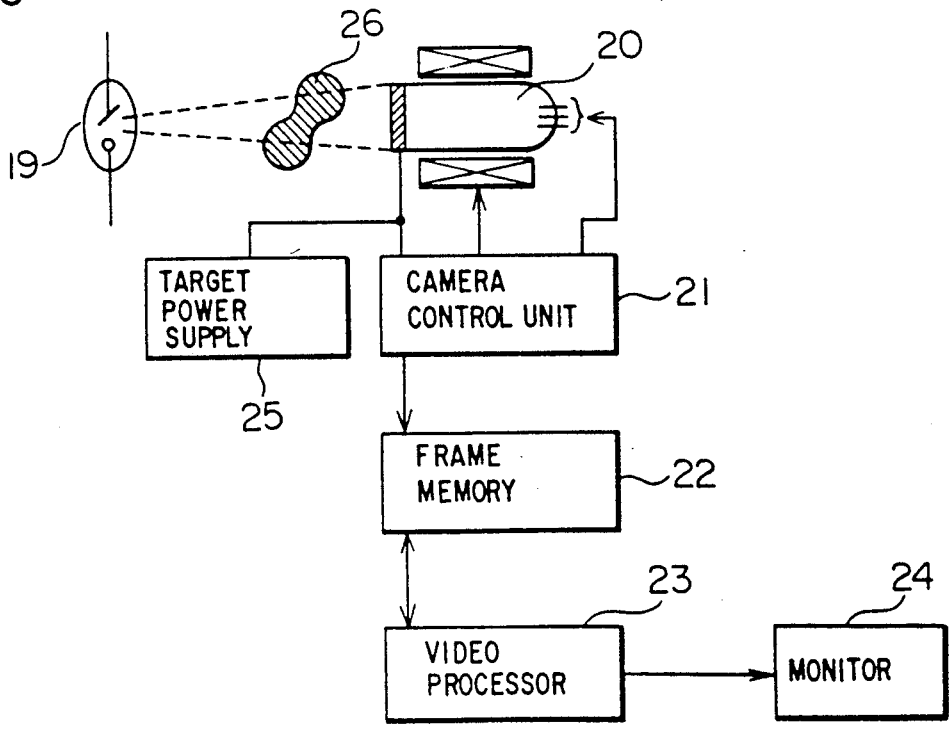
FIG. 16 is a diagram schematically showing a construction of an X-ray analysis system employing an X-ray image pick-up tube fabricated according to the present invention.

A construction of an X-ray analysis system using an X-ray image pick-up tube according to the present invention is schematically shown in FIG. 16. Numeral 19 designates an X-ray source, numeral 20 an X-ray image pick-up tube according to the present invention, numeral 21 a camera control unit, numeral 22 a frame memory, numeral 23 an image processor, numeral 24 a monitor, numeral 25 a target power supply, and numeral 26 an object to be imaged. When this system was actuated with a voltage applied to the image pick-up tube from the target power supply, a satisfactory X-ray analyzed image could be produced without any waterfall or inversion phenomenon even if the target voltage is increased to as high as 600 V.

As will be understood from the foregoing description, according to the present invention, an image pick-up tube is realized which is capable of being operated with an increased target or mesh voltage without any waterfall or inversion phenomenon, thereby remarkably improving the various characteristics including sensitivity, resolution and residual image of an image pick-up tube.

A photoconductive image pick-up tube according to the present invention is suitably used with a television camera or, in particular a High-Definition camera. An image pick-up tube according to the present invention, which is operable with high sensitivity, assures a signal processing with a high S/N value if applied to an X-ray image analysis system.

We claim:

1. An image pick-up tube comprising a target section including at least a conductive film and a photoconductive film on a substrate for photo-electric conversion, and an electron beam scanning system for reading a signal from the target section, wherein at least a part of the surface area outside the effective scanning region of the electron beam scanning side of the target section is formed of a secondary electron emission dampening porous layer.

2. An image pick-up tube according to claim 1, wherein the surface of said target on electron beam scanning side is formed of a porous layer, and said secondary electron emission dampening porous layer is formed of a layer higher in porosity than the porous layer within the effective scanning region of the electron beam.

3. An image pick-up tube according to claim 2, wherein said secondary electron emission dampening porous layer is formed of a compound composed of at least one element selected from the group consisting of Zn, Cd, Ga, In, Si, Ge, Sn, As, Sb and Bi, and at least one element selected from the group consisting of S, Se and Te.

4. An image pick-up tube according to claim 1, wherein said secondary electron emission dampening porous layer is formed of a compound composed of at least one element selected from the group consisting of Zn, Cd, Ga, In, Si, Ge, Sn, As, Sb and Bi, and at least one element selected from the group consisting of S, Se and Te.

5. An image pick-up tube according to claim 4, wherein said secondary electron emission dampening porous layer is formed of a plurality of porous layers, at least one of which is formed of a compound composed of at least one element selected from the group consisting of Zn, Cd, Ga, In, Si, Ge, Sn, As, Sb and Bi, and at least one element selected from the group consisting of S, Se and Te.

6. AN image pick-up tube according to claim 1, wherein the surface of said target on an electron beam scanning side is formed of a porous layer, and said secondary electron emission dampening porous layer is formed of a plurality sublayers higher in porosity than said porous layer within the effective scanning region of the electron beam, at least one of said sublayers being made of a compound composed of at least one element selected from the group consisting of Zn, Cd, Ga, In, Si, Ge, Sn, As, Ab and Bi, and at least one element selected from the group consisting of S, Se and Te.

7. An image pick-up tube according to claim 1, wherein said secondary electron emission dampening porous layer is constructed of C on at least a part of the surface area outside said effective scanning region.

8. An image pick-up tube according to claim 1, wherein at least a part of said photoconductive film is made of an amorphous semiconductor as a main material.

9. An image pick-up tube according to claim 1, wherein at least a part of said conductive film corresponding to said secondary electron emission dampening porous layer is formed separately from the conductive film part corresponding to the surface area within said effective scanning region.

10. An image pick-up tube according to claim 9, wherein said part of the conductive film separately formed corresponding to the surface area within the effective scanning region is connected with an electrode pin arranged through said substrate.

11. An image pick-up tube according to claim 10, wherein said part of the conductive film separately formed corresponding to the secondary electron emission dampening porous layer is impressed with a voltage lower than a predetermined target voltage.

12. An image pick-up tube according to claim 9, wherein said part of said conductive film separately formed corresponding to at least the secondary electron emission dampening porous layer is removed.

13. An image pick-up tube according to claim 1, wherein said substrate is a target substrate made of a material selected from the group consisting of Be and Ti which permits transmission of X-ray therethrough.

14. An image pick-up tube according to claim 13, further comprising means for operating the image pick-up tube in an electric field for increasing charges in said photoconductive film.

15. A television camera using an image pick-up tube comprising a target section including at least a conductive film and a photoconductive film on a substrate for photo-electric conversion, and an electron beam scanning system for reading a signal from the target section, wherein at least a part of the surface area outside the effective scanning region of the electron beam scanning side of the target section is formed of a secondary electron emission dampening porous layer.

16. A television camera according to claim 15, further comprising means for operating said image pick-up tube in an electric field to cause avalanche multiplication within said photoconductive film.

17. An X-ray image analysis system using an image pick-up tube comprising a target section including at least a conductive film and a photoconductive film on a substrate for photo-electric conversion, and an electron beam scanning system for reading a signal from the target section, wherein at least a part of the surface area outside the effective scanning region of the electron beam scanning side of the target section is formed of a secondary electron emission dampening porous layer.

18. An X-ray image analysis system according to claim 17, wherein said substrate is a target substrate made of a material selected from the group consisting of Be and Ti.

19. An X-ray image analysis system according to claim 18, further comprising means for operating the image pick-up tube in an electric field to cause avalanche multiplication with said photoconductive film.

20. A method of fabricating a target section including at least a conductive film and a photoconductive film on a substrate for photo-electric conversion, comprising the steps of forming a predetermined porous layer over the entire area on the electron beam scanning side of the photoconductive film of said target, and superposing a porous layer higher in porosity than said predetermined porous layer on at least a part of the surface area outside the effective scanning region of electron beam in a layer above said predetermined layer thereby to form a secondary electron emission dampening layer.

21. A method of fabricating a target section including at least a conductive film and a photoconductive film on a substrate for photo-electric conversion, comprising the steps of forming a predetermined porous layer over the entire area of the electron beam scanning side on said photoconductive film, and superposing a thin film of C on at least a part of the surface area outside the effective scanning region of electron beam of said predetermined porous layer thereby to form a secondary electron emission dampening layer.

22. A method of fabricating a target section including a conductive film and a photoconductive film on a substrate for photo-electric conversion, comprising the steps of forming a porous layer by arranging on said photoconductive film a mesh mask having a part thereof corresponding to at least a part of the surface area outside the effective scanning region, said part having a higher transmittance than the effective scanning region of electron beam, and forming a secondary electron emission dampening layer on said part higher in transmittance.

23. A method of fabricating a target section including at least a conductive film and a photoconductive film on a substrate for photo-electric conversion, comprising the steps of forming a predetermined porous layer over the entire surface area of said photoconductive film, removing a part of said porous layer corresponding to the surface area inside the effective scanning region of electron beam, and laminating a different porous layer over the entire area of the electron beam scanning side thereby to form a secondary electron emission dampening layer on the surface area outside the effective scanning region.

* * * * *